US009193192B1

(12) United States Patent
Regelsberger et al.

(10) Patent No.: US 9,193,192 B1
(45) Date of Patent: Nov. 24, 2015

(54) REDUCING PRINT ARTIFACTS USING ISOLATED TENSION ZONES

(71) Applicants: Matthias H. Regelsberger, Rochester, NY (US); Randy E. Armbruster, Rochester, NY (US)

(72) Inventors: Matthias H. Regelsberger, Rochester, NY (US); Randy E. Armbruster, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 14/472,437

(22) Filed: Aug. 29, 2014

(51) Int. Cl.
*B41J 29/393* (2006.01)
*B41J 15/16* (2006.01)

(52) U.S. Cl.
CPC ..... *B41J 15/16* (2013.01)

(58) Field of Classification Search
CPC ..... B41J 29/393; B41J 29/38; B41J 29/02; B41J 11/42; B41J 13/02; B41J 13/106
See application file for complete search history.

(56) References Cited

U.S. PATENT DOCUMENTS

| | | | | |
|---|---|---|---|---|
| 4,572,417 | A | 2/1986 | Joseph et al. | |
| 4,795,070 | A | 1/1989 | Blanding et al. | |
| 4,901,903 | A | 2/1990 | Blanding | |
| 6,431,778 | B1 * | 8/2002 | Coudray et al. | 400/635 |
| 6,550,908 | B1 * | 4/2003 | Heitz et al. | 347/104 |
| 8,104,861 | B2 | 1/2012 | Saettel et al. | |
| 8,562,097 | B2 * | 10/2013 | Muhl | 347/16 |
| 2009/0122126 | A1 | 5/2009 | Ray et al. | |
| 2013/0286071 | A1 | 10/2013 | Armbruster et al. | |
| 2014/0064817 | A1 | 3/2014 | Niertit et al. | |

* cited by examiner

*Primary Examiner* — Lamson Nguyen
(74) *Attorney, Agent, or Firm* — Amit Singhal

(57) ABSTRACT

A method and system for reducing registration errors in a printing system are disclosed. A plurality of tension zones is defined in the printing system. Tension on the web in one tension zone is controlled independently of the tension on the web in the other tension zones. The printing system also includes at least one roller for each tension zone. The rollers receive tension control commands and control the amount of tension on the web in their respective tension zones. The printing system is used to print a first copy of the print job on the web and a plurality of registration errors is determined. Tension control adjustments are computed for each tension zone based on the registration errors. The tension control adjustments are used to adjust the tension control commands to the rollers to print a second copy of the print job, thereby reducing registration errors.

20 Claims, 16 Drawing Sheets

REDUCING PRINT ARTIFACTS USING ISOLATED TENSION ZONES

CROSS REFERENCE TO RELATED APPLICATIONS

Reference is made to commonly-assigned, U.S. patent application Ser. No. 14/191,491, entitled "SYSTEM FOR REDUCING ARTIFACTS USING TENSION CONTROL", Ser. No. 14/191,495, entitled "METHOD FOR REDUCING TENSION FLUCTUATIONS ON A WEB", Ser. No. 14/191,498, entitled "SYSTEM FOR REDUCING TENSION FLUCTUATIONS ON A WEB", and Ser. No. 14/191,489, entitled "METHOD FOR REDUCING ARTIFACTS USING TENSION CONTROL", all filed Feb. 27, 2014.

Reference is made to commonly-assigned, U.S. patent application Ser. No. 14/472,447, entitled "REDUCING PRINT ARTIFACTS USING ISOLATED TENSION ZONES", Ser. No. 14/472,456, entitled "REDUCING TENSION FLUCTUATIONS USING ISOLATED TENSION ZONES", Ser. No. 14/472,461, entitled "REDUCING TENSION FLUCTUATIONS USING ISOLATED TENSION ZONES", all filed Aug. 29, 2014.

FIELD OF THE INVENTION

The present invention generally relates to printing apparatus for web of print media and more particularly to controlling tension of web of print media in a printing system to reduce printing artifacts such as color-to-color registration and stabilize tension fluctuations of the web of print media.

BACKGROUND OF THE INVENTION

Continuous web printing permits economical, high-speed, high-volume print reproduction. In this type of printing, a continuous web of paper or other substrate material is fed past one or more printing subsystems that form images by applying one or more colorants onto the substrate surface. In a conventional web-fed rotary press, for example, a web substrate is fed through one or more impression cylinders that perform contact printing, transferring ink from an imaging roller onto the web in a continuous manner.

Proper registration of the substrate to the printing device is of considerable importance in applications such as print reproduction, particularly where multiple colors are used in printing color images. Similarly, in the printing of electrical circuits, proper registration is critical in the deposition of electrically conductive or insulating layers in forming a multi-layer electrical circuit such as touch panels. Conventional web transport systems in today's commercial offset printers address the problem of web registration with high-precision alignment of machine elements. Typical of conventional web handling subsystems are heavy frame structures, precision-designed components, and complex and costly alignment procedures for precisely adjusting substrate transport between components and subsystems.

Alignment during actual print production is aided by vision systems monitoring the printed output in real time, comparing the output with a reference image and displaying the information to the operator to consider taking corrective actions. Such vision systems can monitor the color reproduction or the registration or both aspects of the print production to ensure the desired output quality.

The problem of maintaining precise and repeatable web registration and transport becomes even more acute with the development of high-resolution non-contact printing, such as high-volume inkjet printing. With this type of printing system, finely controlled dots of ink are rapidly and accurately propelled from a print station onto the surface of the moving media, with the web substrate often coursing past the print station at speeds measured in hundreds of feet per minute. No impression roller is used; synchronization and timing are employed to determine the exact timing of the sequential deposition of ink by different print stations onto the moving media. The requirements for the printed output are driven by intended use and function of the printed product. For any multi-step printing process, the image quality attributes always include registration, print resolution and the reduction of print artifacts. Other attributes, specific to the output can be added, for example color reproduction for graphic arts printing. With dot resolution of 600 dots-per-inch (DPI) and better, a high degree of registration accuracy can be achieved theoretically, limited only by the digital resolution inherent in the digital print station. During printing, variable amounts of ink is applied to different portions of the rapidly moving web, with drying mechanisms typically employed after each print station or bank of print stations. Variability in ink or other liquid amounts and types and in drying time can cause substrate stiffness and tension characteristics to vary dynamically over a range for different types of substrate, contributing to the overall complexity of the substrate handling and registration challenge.

One approach to the registration problem is to provide a print module that forces the web of print media along a tightly controlled print path. This is the approach that is exemplified in U.S. Patent Publication No. 2009/0122126, entitled "Web Flow Path" by Ray et al. In such a system, there are multiple drive rollers that fix and constrain the web of print media position as it moves past one or more print stations.

Problems with such a conventional approach include significant cost in design, assembly, adjustment, and alignment of web handling components along the media path. While such a conventional approach permits some degree of modularity, it would be difficult and costly to expand or modify a system with this type of design. Each "module" for such a system would itself be a complete printing apparatus, or would require a complete, self-contained subassembly for paper transport, making it costly to modify or extend a printing operation, such as to add one or more additional colors or processing steps, for example.

Various approaches to web tracking are suitable for various printing technologies. For example, active alignment steering, as taught for an electrographic reproduction web (often referred to as a belt on which images are transported) in commonly assigned U.S. Pat. No. 4,572,417 entitled "Web Tracking Apparatus" to Joseph et al. would require multiple steering stations for continuous web printing, with accompanying synchronization control. It would be difficult and costly to employ such a solution with a print medium whose stiffness and tension vary during printing, as described above. Other solutions for web (or belt as referred to above) steering are similarly intended for endless webs in electro-photographic equipment but are not readily adaptable for use with paper media. Steering using a surface-contacting roller, useful for low-speed photographic printers and taught in commonly assigned U.S. Pat. No. 4,795,070 entitled "Web Tracking Apparatus" to Blanding et al. would be inappropriate for a surface that is variably wetted with ink and would also tend to introduce non-uniform tension in the cross-track direction. Other solutions taught for photographic media, such as those disclosed in commonly assigned U.S. Pat. No. 4,901,903 entitled "Web Guiding Apparatus" to Blanding are well suited to photographic media moving at slow to moderate speeds but are inappropriate for systems that need to accommodate a wide range of media, each with different characteristics, and transport each media type at speeds of hundreds of feet per minute.

In order for high-speed non-contact printers to compete against earlier types of devices in the commercial printing market, the high cost of the web transport should be greatly reduced. There is a need for an adaptable non-contact printing system that can be fabricated and configured without the cost of significant down-time, complex adjustment, and constraint on web of print media materials and types.

One aspect of such a system relates to components that feed the continuous web substrate into the printing system and guide the web of print media into a suitable cross-track position for subsequent transport and printing. This problem is exacerbated by the shrinking and expanding of web of print media due to wetting and drying. The change in the structure of the web of print media results in color-to-color registration errors during printing.

In other applications such as the manufacture of touch screens, the web of print media is typically made of plastic with a solvent based ink used in the printing process. Drying at elevated temperatures will change the dimensions of the support during the printing process much like in conventional printing applications.

In commercial inkjet printing systems, the web of print media is physically transported through the printing system at a high rate of speed. For example, the web of print media can travel 650 to 1000 feet per minute. The print stations in commercial inkjet printing systems typically include multiple jetting modules that jet ink onto the web of print media as the web of print media is being physically moved through the printing system. A reservoir containing ink or some other material is typically behind each nozzle plate in a print station. The ink streams through the nozzles in the nozzle plates when the reservoirs are pressurized.

The jetting modules in each print station in commercial printing systems typically jet only one color. In printing systems designed to manufacture electrical circuits, the jetting modules in each print station jet only electrically conductive inks, electrically insulating inks or inks to form protective coatings for the circuit. In printing systems designed for commercial printing or system designed to manufacture electrical circuits, the sequential deposition of inks along the conveyance path of the print media will form the printed product. The quality requirements and attributes of the printed product are derived from the use and application of the printed product. For example, in commercial printing systems the registration of the four colors forming the color image has to be performed precisely, the printed image should not have image artifacts and the overall color reproduction should resemble closely the color of the original object. In the manufacture of electrical circuits, the registration of the insulating and conductive layers should be performed precisely to avoid electrical short circuits. There should be no image artifacts such as voids affecting the electrical traces, making them non-conductive. Similarly, the crossing of two conductors not properly insulated from each other should be avoided. The current carrying capacity of each trace can require a certain density of conductive ink. For each of the example applications, the ink is jetted sequentially and deposited on the moving print media web as it is conveyed passed multiple print stations. In the examples, the printed output is composed of multiple layers, also referred to as separations, which should be aligned to each other to produce a single color impression for the observer of the commercial print or the desired function selected by the user on the touch screen panel forming the user interface.

The mis-alignment of layers or separations of a multi-layer print is typically referred to as registration error. Registration errors are partitioned into different types. Examples of registration errors include, but are not limited to, a separation having a linear translation with respect to another separation, a separation being rotated with respect to another separation, and a separation being stretched, contracted, or both stretched and contracted with respect to another separation. There are several variables that contribute to the registration errors in separation alignment including physical properties of the web of print media, conveyance of web of print media, ink application system, ink coverage, and drying of ink. Registration errors can be reduced by controlling these variables.

US 20140064817 discloses operating a printer at a fixed drive speed ratio during printing to reduce registration errors as compared to operating at a servo controlled tension. Stretch and tension are related through the elastic modulus of the web. If the modulus of the web is fluctuating due to inking of the paper and the tension is held constant then the stretch must vary to account for the changing modulus. On the other hand if a fixed speed ratio is maintained, yielding a fixed paper stretch, the tension must fluctuate to account for the modulus fluctuations. If the modulus of the paper fluctuates due to inking of the paper at least one of the stretch and the tension must fluctuate as well. If the tension is servoed so that it doesn't change, as in US 20140064817, then the stretch of the paper must fluctuate which hurts registration.

There is, then, a need for a tension control system that can reduce registration errors by controlling the conveyance of the web of print media in a high-speed commercial printing system for non-contact printing applications and compensate for varying tensions in the receiver web due to modulus changes of the material such as paper or plastic due to the sequential inking and drying steps employed to form the final image on the receiver web.

SUMMARY OF THE INVENTION

The present invention is directed to systems and methods for controlling tension in a web of print media to reduce registration errors and tension fluctuations in a printing system.

According to an aspect of the present invention, a method for using tension control adjustments on a web to reduce registration errors comprises:

- providing a printing system with a first print station disposed opposite a first side of the web, wherein the first print station defines one or more print zones where a liquid is deposited onto the first side of the web;
- defining a plurality of tension zones in the printing system, wherein tension on the web in one tension zone is controlled independently of the tension on the web in the other tension zones;
- for each tension zone, providing a first roller adapted to receive tension control commands, the tension control commands operating on the first roller to control the amount of tension of the web in the tension zone;
- using the printing system to print a first copy of the print job on the web;
- determining a plurality of registration errors produced during the printing of the first copy of the print job;
- using a processor to determine first tension control adjustments for each tension zone in the printing system based on the plurality of registration errors; and using the first tension control adjustments to adjust the tension control commands to the first rollers of each of the tension zones in the printing system to print a second copy of the print job, thereby reducing registration errors.

The methods and systems of the present invention provide several significant advantages. Controlling the tension in the web in the printing system permits the system to have fewer constraints. The printing system can be made in a modular manner, adding or removing print stations and associating each with its own tension zone, without the need for expensive alignment and registration of various transport and constraint rollers. The web can be self-aligned, permitting a simpler organization of the components of the printing system. Wetting of the web due to ink laydown, and subsequent drying, can expand or shrink the web, resulting in registration errors between successive printings on the same portion of the web. The present invention provides methods and systems for using tension control in the web to reduce registration errors due to deformations of the web. Further, deformations in the web can cause a change in the tension in the web, resulting in the formation of folds or wrinkles in the web. The tension control adjustments can be used to stabilize tension fluctuations in the web due to deformations from wetting and drying, resulting in a reduction in the formation of folds and wrinkles in the web.

Controlling the tension in the web limits flutter or the up-and-down movement of the web in the printing system, permitting a position sensing system, such as a vision system to more precisely measure the position of the registration or alignment marks on the web.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
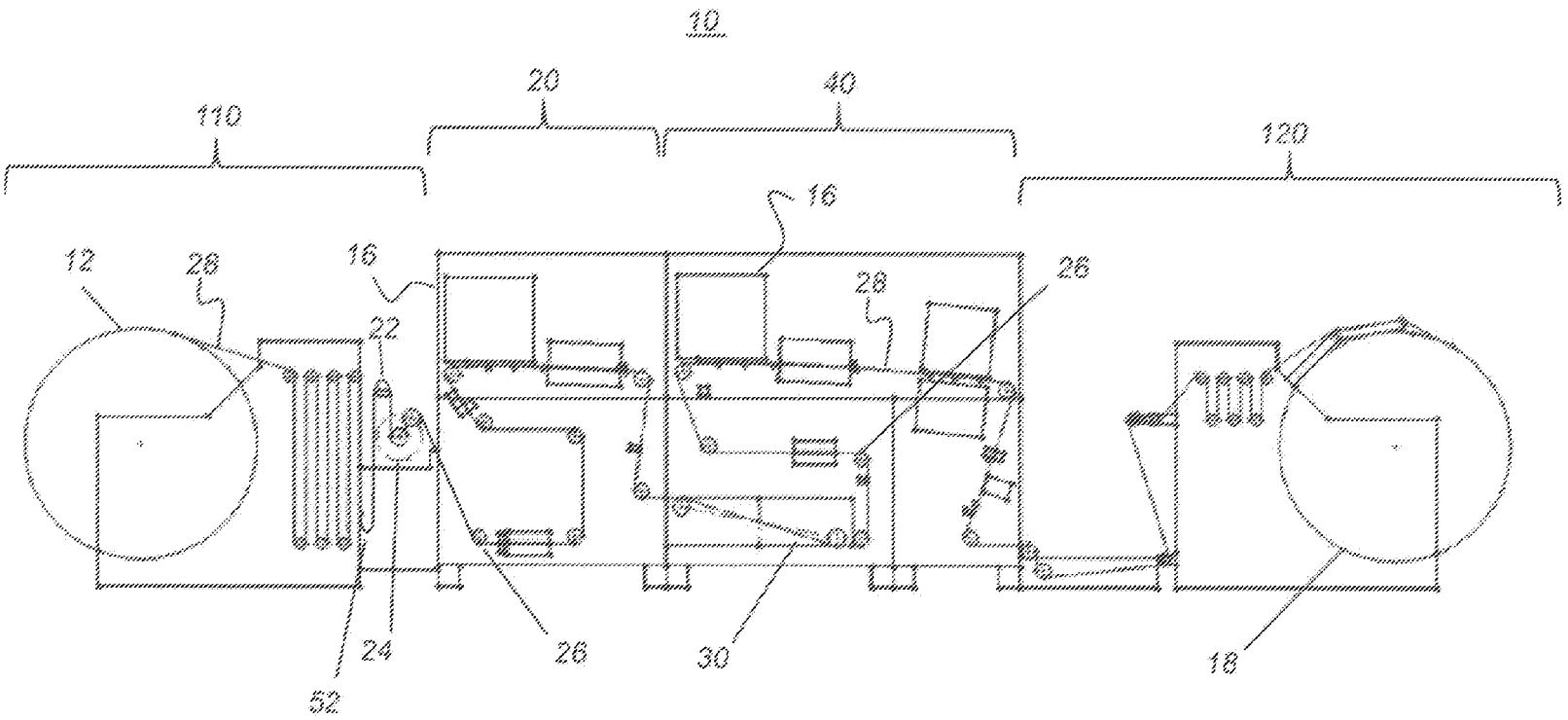
FIG. 1 is a schematic side view of a digital printing system according to an aspect of the present invention.

The present description will be directed in particular to elements forming part of, or cooperating more directly with, apparatus in accordance with the present invention. It is to be understood that elements not specifically shown or described can take various forms well known to those skilled in the art.

The method and system of the present invention provide a modular approach to the design of a digital printing system, utilizing features and principles of exact constraint for transporting a continuously moving web of print media past one or more digital print stations. The system and method of the present invention are particularly well suited for printing systems that provide non-contact application of water-based or solvent-based inks onto a continuously moving medium for the purpose of producing, for example, multi-color prints on paper or for the manufacture of multi-layered electrical circuits on plastic foil. The print station of the present invention image-wise applies inks to at least some portion of the web of print media as it courses through the printing system, but without the need to make contact with the web of print media. The terms web of print media, web, and print media are used interchangeably in the disclosure and are understood to refer to a continuous web of print media.

In the context of the present disclosure, the term "continuous web of print media" relates to a print media that is in the form of a continuous strip of media as it passes through the printing system from an entrance to an exit thereof. The continuous web of print media itself serves as the receiving print medium to which one or more printing ink or inks or other coating liquids are applied in non-contact fashion. This is distinguished from various types of "continuous webs" or "belts" that are actually transport system components rather than receiving print media and that are typically used to transport a cut sheet medium in an electro-photographic or other printing system. The terms "upstream" and "downstream" are terms of art referring to relative positions along the transport path of a moving web; points on the web move from upstream to downstream. Where they are used, the terms "first", "second", and so on, do not necessarily denote any ordinal or priority relation, but are simply used to more clearly distinguish one element from another.

In order to provide a digital printing system for non-contact printing onto a continuous web of print media at high transport speeds, the apparatus and method of the present invention apply a number of exact constraint principles to the problem of web handling and web tensioning, including the following:

(a) Employing, over each span of web of print media from one roller to the next in each tension zone, a pairing of lateral and angular constraints, with the angular constraint downstream of the lateral constraint. Over each web span subsequent to the first web span in the system, the method uses the given lateral position of the web received from the upstream web span as the lateral constraint.

(b) Use of zero-constraint castered rollers, non-rotating surfaces, or low wrap angle rollers where it is desirable to guide the print media without introducing either a lateral or angular constraint to the web. This is the case, for example, where there is an overhang condition, where some length of the web within a web span extends past the angular constraint for that web span.

(c) Use of gimbaled rollers where desirable to provide an angular constraint, taking advantage of the capability of the web to twist without over-constraint. Use of gimbaled only rollers where desirable to provide an angular constraint in the web span immediately upstream while imparting no angular constraint in the web span immediately downstream of that roller.

The digital printing systems having one or more print stations that selectively moisten at least a portion of the print media as described above include a print media transport system that serves as a support structure to guide the continuous web of print media. The support structure includes an edge guide or other mechanism that positions the print media in the cross track direction. This first mechanism is located upstream of the print stations of the digital printing system. The print media is pulled through the digital printing system by a driven roller that is located downstream of the print stations. The systems also include a mechanism located upstream of print stations of the printing system for establishing and setting the tension of the print media. Typically it is also located downstream of the first mechanism used for positioning the print media in the cross track direction. The transport system also includes a third mechanism to set an angular trajectory of the print media. This can be a fixed roller (for example, a non-pivoting roller) or a second edge guide. The printing system also includes a roller affixed to the support structure, the roller configured to align to the print media being guided through the printing system without necessarily being aligned to another roller located upstream or downstream relative to the roller. The castered, gimbaled, or castered and gimbaled rollers serve in this manner.

Kinematic web handling is provided not only within each module of the system of the present invention, but also at the interconnections between modules, as the continuously moving web medium passes from one module to another. Unlike a number of conventional continuous web imaging systems, the apparatus of the present invention does not require a slack loop between modules, but can use a slack loop only for print media that has been just removed from the supply roll at the input end. Removing the need for a slack loop between modules or within a module permits addition of a module at any position along the continuously moving web, taking advantage of the self-positioning and self-correcting design of print media path components.

The system and methods of the present invention adapt a number of exact constraint principles to the problem of web handling. As part of this adaptation, disclosed are ways to permit the moving web to maintain proper cross-track registration in a "passive" manner, with a measure of self-correction for web alignment. Steering of the web is avoided unless absolutely necessary; instead, the web's lateral and angular positions in the plane of transport are exactly constrained. Moreover, other web support devices used in transporting the web, other than non-rotating surfaces or those devices purposefully used to exactly constrain the web, are permitted to self-align with the web. The digital printing system according to this invention includes one or more modules having rollers that guide the web of print media as it passes at least one non-contact digital print station. The digital printing system can also include components for drying or curing of the printing fluid on the print media; for inspection of the print media, for example, to monitor and control print quality; and various other functions. The digital printing system receives the print media from a media source, and after acting on the print media conveys it to a media receiving unit. The print media is maintained under tension as it passes through the digital printing system, but it is not under tension as it is received from the media source.

Referring to the schematic side view of FIG. 1, there is shown a digital printing system 10 for continuous web printing according to an aspect of the present invention. A first module 20 and a second module 40 are provided for printing on continuous web of print media 28 that originates from a source roller 12. Following an initial slack loop 52, the print media 28 that is fed from source roller 12 is then directed through digital printing system 10, past one or more digital print stations 16 and supporting printing system 10 components. The print stations 16 define print zones 54 (see FIG. 2) in the printing system where ink or other liquid is jetted onto the print media 28. First module 20 has a support structure that includes a cross-track positioning mechanism 22 for positioning the continuously moving web of print media 28 in the cross-track direction, that is, orthogonal to the direction of travel and in the plane of travel. In one aspect of the present invention, cross-track positioning mechanism 22 is an edge guide for registering an edge of the moving print media.

A tensioning mechanism 24, affixed to the support structure of first module 20, includes structure that sets the tension of the print media 28. According to aspects of the present invention, various components of the printing system 10 can be arranged as isolated tension zones, where the tensioning mechanism controls the tension of the print media 28 in each tension zone irrespective, and in isolation from, the tension on the print media 28 in another tension zone. The digital printing system 10 shown in FIG. 1 includes four tension zones. The first tension zone corresponds to the input equipment or supply roll assembly 110. The second and third tension zones corresponds to first module 20 and second module 40, respectively. The fourth tension zone corresponds to the output equipment or take-up roll assembly 120. The input equipment 110 includes a slack loop 52 and a tensioning mechanism 24 to isolate the first tension zone corresponding to the supply roll assembly from the other tension zones in the printing system. A similar slack loop and tensioning mechanism can be provided in the output equipment 120 to separate the tension zone corresponding to the supply roll assembly from the other tension zones in the printing system. The tensioning mechanisms 24 can be used to control the tension of the print media 28 in the supply and take-up rolls independent of the tension control adjustments of the print media in the first and second modules of the printing system.

Isolating the input equipment and output equipment tension zones from the first and second module tension zones permits the digital printing system to avoid drive uniformities, such as wobble of non-round paper rolls or paper rolls with flat spot, from affecting the first and second module tension zones. The tension of the print media can be set independently for each tension zone in the printing system, and controlled independently of the tension adjustments in upstream or downstream tension zones. This provides uniform motion of the print media using steady and consistent tension. The tension of the print media can be determined as a function of the print media support structure.

In an aspect of the invention, the turnbar module 30 includes high wrap angle rollers 34 and 36 to separate the tension zones corresponding to the first and second modules from each other.

Downstream from first module 20, along the path of the continuous web of print media 28, second module 40 also has a support structure, similar to the support structure for first module 20. Affixed to the support structure of either or both the first or second module 20 or 40 is a kinematic connection mechanism that maintains the kinematic dynamics of the continuous web of print media in traveling from the first module 20 into the second module 40. Also affixed to the support structure of either the first or second module 20 or 40 are one or more angular constraint structures 26 for setting an angular trajectory of the web of print media 28.

Figure 4:
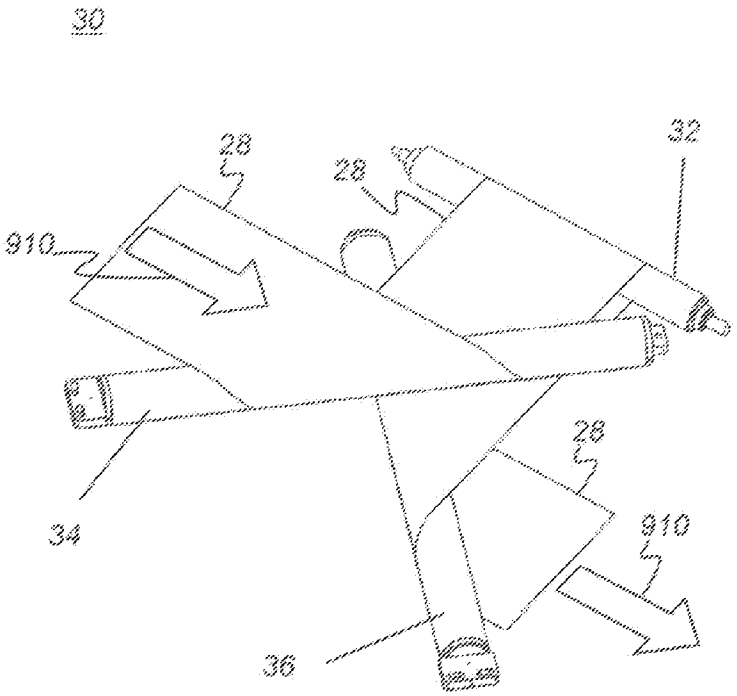
FIG. 4 is an isometric view showing the arrangement of rollers and surfaces within the turnbar module in an aspect of the invention without including the support structure.
Figure 3:
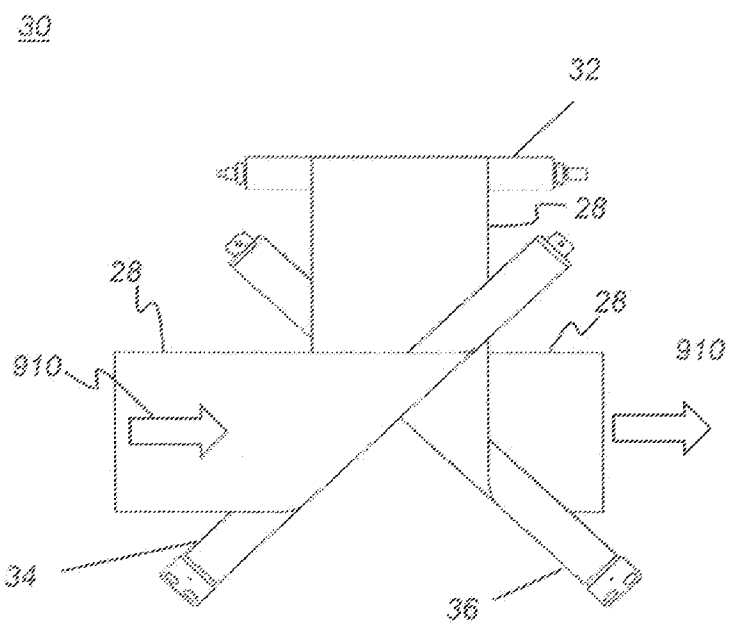
FIG. 3 is a top view showing the arrangement of rollers and surfaces within the turnbar module in as aspect of the invention without including the support structure.

Still referring to FIG. 1, printing system 10 optionally also includes a turnbar module 30 that is configured to turn the print media 28 over, flipping it backside-up in order to print on the reverse side. The web path and roller placement within turnbar (TB) module 30 is shown in FIGS. 3 and 4 and is discussed below in further detail. The print media 28 then leaves the digital printing system 10 and travels to a media receiving unit, in this case a take-up roll 18. A take-up roll 18 is then formed, rewound from the printed web of print media. The digital printing system can include a number of other components, including multiple print heads and dryers, for example, as described in more detail subsequently. Other examples of system components include web cleaners, web tension sensors, and quality control sensors.

Figure 2:
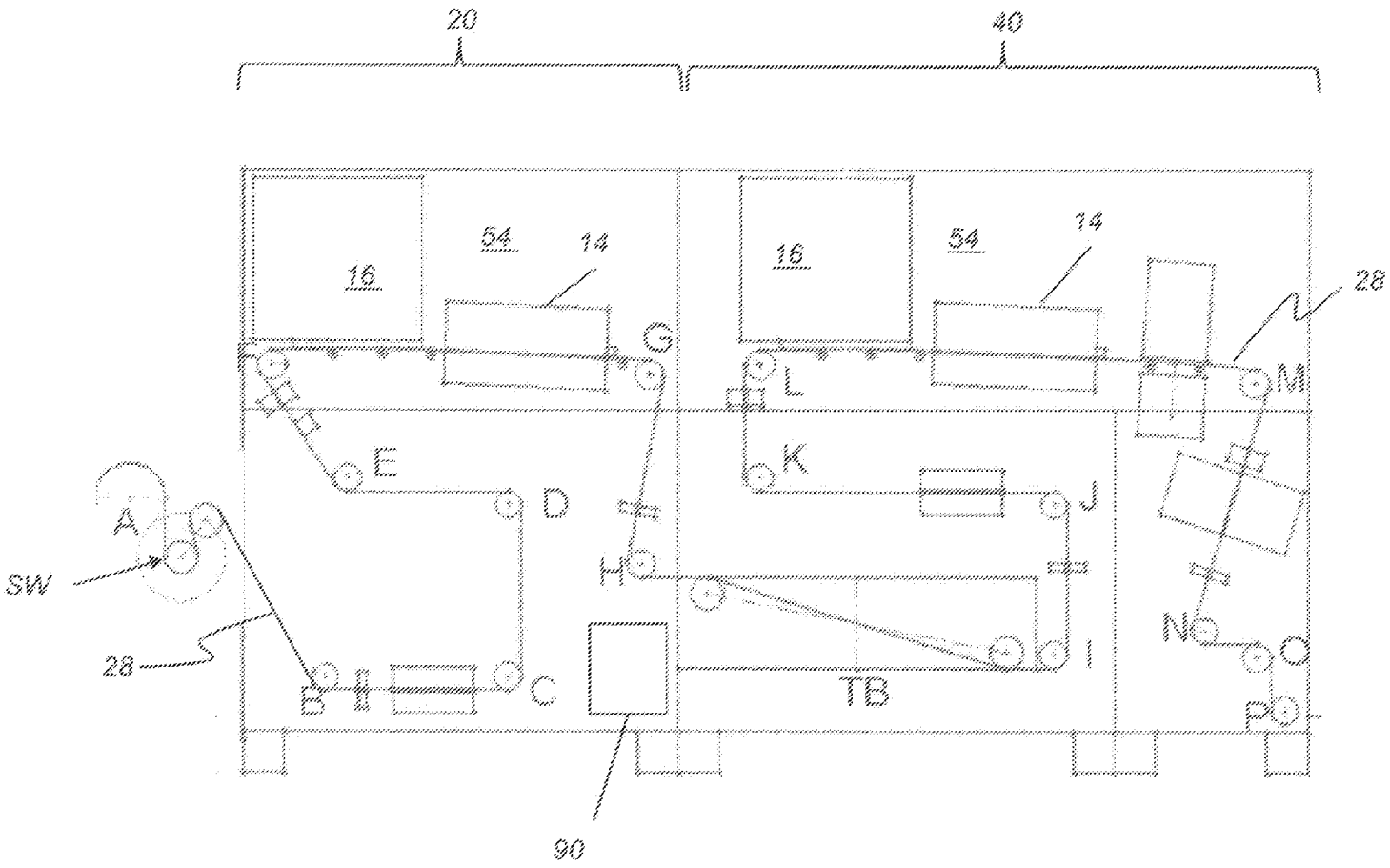
FIG. 2 is an enlarged schematic side view of media transport components of the digital printing system shown in FIG. 1.

The schematic side view diagram of FIG. 2 shows, at enlarged scale from that of FIG. 1, the media routing path through modules 20 and 40 according to one aspect of the present invention. Within each module 20 and 40, in a print zone 54, each print station 16 is followed by a dryer 14.

Table 1 that follows identifies the lettered components used for web of print media transport and shown in FIG. 2. An edge guide in which the print media is pushed laterally so that an edge of the print media contacts a stop is provided at A. The slack web entering the edge guide permits the print media to be shifted laterally without interference and without being overconstrained. An S-wrap device SW provides stationary curved surfaces over which the continuous web slides during transport. As the web is pulled over these surfaces, the friction of the web across these surfaces produces tension in the print media 28. In one aspect of the present invention, the S-wrap device permits for an adjustment of the positional relationship between surfaces to control the angle of wrap and to permit adjustment of web tension.

In Table 1, two separate tension zones are identified, according to an aspect of the present invention. Tension Zone #1 stretches from infeed drive roller B to Turnbar module (TB) containing the main drive roller. This tension zone is equipped with a web tension sensing sensor on roller D. Tension Zone #2 stretches from Turnbar (TB) containing the main drive motor to outfeed drive roller N. Tension Zone #2 is equipped with a web tension sensing sensor on roller J. In order to enable stable tension control within these modules, the input equipment is separated by a festoon (integrated into the unwinder) and a slack loop as shown in FIG. 1 or other device to isolate variations in tension from the supply roller. Similarly, on the output side, a similar arrangement is used to isolate the variations in tension within the printing equipment from variations in tensions of the finishing equipment.

TABLE 1

Roller Listing for FIG. 2

| Media Handling Component | Type of Component | |
|---|---|---|
| A | Lateral constraint (Edge guide) | |
| SW-S-Wrap | Zero constraint (Non-rotating support). Tensioning. | |
| B | Angular constraint (infeed drive roller) | Tension Zone #1 |
| C | Zero constraint (Castered and Gimbaled Roller) | Tension Zone #1 |
| D * | Angular constraint with hinge (Gimbaled Roller) | Tension Zone #1 |
| E | Angular constraint with hinge (Gimbaled Roller) | Tension Zone #1 |
| F | Angular constraint (Fixed Roller) | Tension Zone #1 |
| G | Zero constraint (Castered and Gimbaled Roller) | Tension Zone #1 |
| H | Angular constraint with hinge (Gimbaled Roller) | Tension Zone #1 |
| TB(TURNBAR) | See FIGS. 3 and 4 | |
| I | Zero constraint (Castered and Gimbaled Roller) | Tension Zone #2 |
| J * | Angular constraint with hinge (Gimbaled Roller) | Tension Zone #2 |
| K | Angular constraint with hinge (Gimbaled Roller) | Tension Zone #2 |
| L | Angular constraint (Fixed Roller) | Tension Zone #2 |
| M | Zero constraint (Castered and Gimbaled Roller) | Tension Zone #2 |
| N | Angular constraint (outfeed drive roller) | Tension Zone #2 |

Note:
Asterisk (*) indicates locations of load cells.

The first angular constraint is provided by infeed drive roller B. This can be a fixed roller that cooperates with a drive roller in the turnbar module and with an outfeed drive roller N in second module 40 in order to move the web through the printing system with suitable tension in the movement direction (in-track direction). The tension provided by the preceding S-wrap device serves to hold the web against the infeed drive roller so that a nip roller is not required at the drive roller. Angular constraints at subsequent locations downstream along the web are often provided by rollers that are gimbaled so as not to impose an angular constraint on the next downstream web span.

In this aspect of the invention, the angular orientation of the print media 28 in the print zone containing one or more print stations and one or more dryers is controlled by a roller placed immediately before or immediately after the print zone. This is desirable for ensuring registration of the print from multiple print stations. It is also desirable that the web not be over-constrained in the print zone. This is done by placing a constraint relieving roller such as a castered roller following the print zone or a gimbaled roller preceding the print zone. To maintain control of the transit time of the print drops from the jetting module to the print media 28, variations in spacing of the print station to the print media from one side of the print station to the other need to be controlled, and it is desirable to orient the printheads parallel to the print media. To maintain the uniformity of this spacing between the print station and the print media, preferably, the constraint relieving roller placed at one end of the print zone is not free to pivot in a manner that will alter the print station to print media spacing. Therefore a gimbaled roller preceding the print zone should not have a caster pivot as well. Similarly, the castered roller following the print zone should preferably not include a gimbal pivot. The use of nonrotating supports (brushbars) under the print media 28 to support the print media in the print zone can be used to maintain proper spacing between the print media and the printheads in the print zones.

The top view of FIG. 3 and the isometric view of FIG. 4 show the arrangement of rollers for turnbar module (TB) 30, shown as part of second module 40 (in FIGS. 1 and 2). Turnbar module TB can optionally be configured as a separate tension zone, with its own web of print media 28 handling compatible with that of second module 40. The position of turnbar module TB is appropriately between print zones 54 for opposite sides of the print media 28. Here, a fixed drive roller 32 (which may have one or more associated nip rollers, not shown) of this device provides the single angular constraint. Lateral constraint is provided by the position of the moving web upstream of stationary turnbar 34. Stationary turnbars 34 and 36 are positioned at diagonals to that the input and output paths and impart no constraint on the web as it slides over them.

The system of the present invention is adaptable for a printing system of variable size and permits straightforward reconfiguration of the system without requiring precise adjustment and alignment of rollers and related hardware when modules are combined. The use of exact constraint mechanisms means that rollers can be mounted within the equipment frame or structure using a reasonable amount of care in mechanical placement and seating within the frame, but without the need to individually align and adjust each roller along the path, as would be necessary when using conventional paper guidance mechanisms. That is, roller alignment with respect to either the media path or another roller located upstream or downstream is not required.

Figure 5:
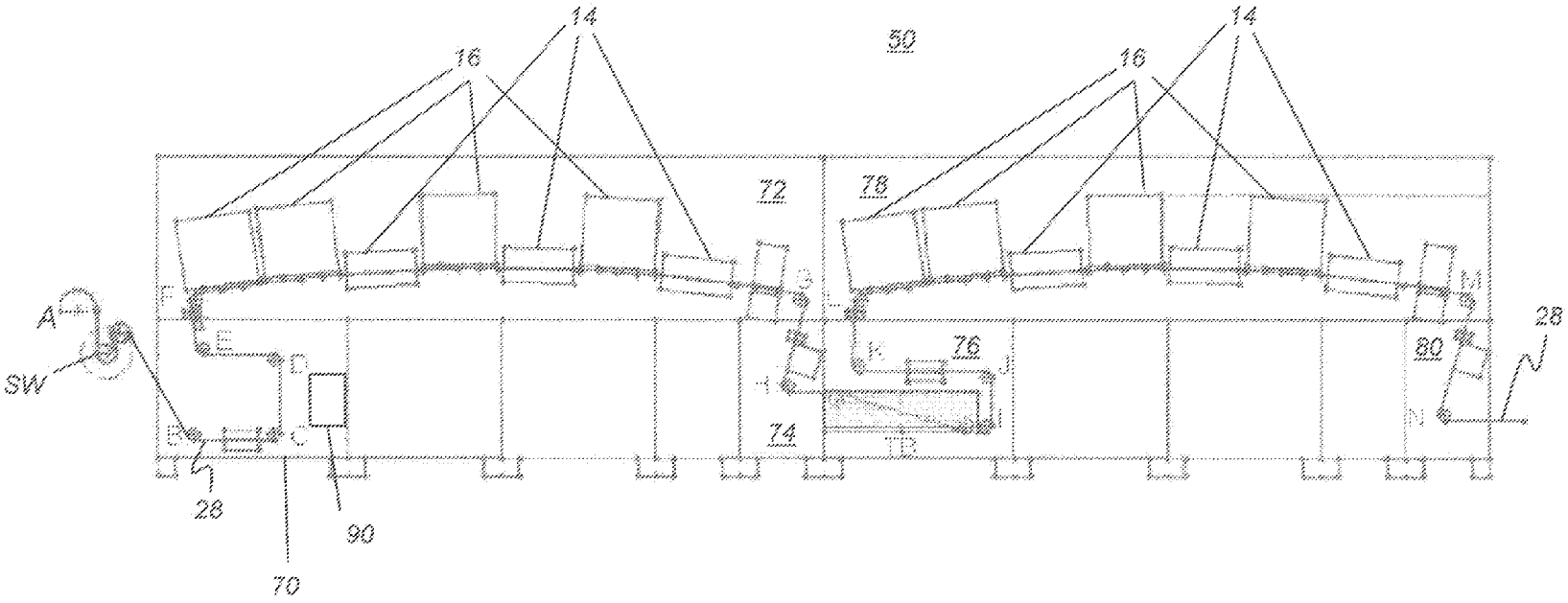
FIG. 5 is a schematic side view of a large-scale two-sided digital printing system according to another aspect of the present invention.

A digital printing system 50 shown schematically in FIG. 5 has a considerably longer print path than that shown in FIG. 2, but provides the same overall sequence of angular constraints, with the same overall series of gimbaled, castered, and fixed rollers. Table 2 lists the roller arrangement used with the system of FIG. 5 according to one aspect of the present invention. Brush bars between rollers F and G and between L and M in FIG. 5, are non-rotating surfaces and thus apply no lateral or angular constraint forces.

TABLE 2

Roller Listing for FIG. 5

| Media Handling Component | Type of Component |
|---|---|
| A | Lateral constraint (edge guide) |
| SW - S-Wrap | Zero constraint (non-rotating support) |

TABLE 2-continued

Roller Listing for FIG. 5

| Media Handling Component | Type of Component | |
|---|---|---|
| B | Angular constraint (infeed drive roller) | Tension Zone #1 |
| C | Zero constraint (Castered and Gimbaled Roller) | |
| D * | Angular constraint with hinge (Gimbaled Roller) | |
| E | Angular constraint with hinge (Gimbaled Roller) | |
| F | Angular constraint (Fixed Roller) | |
| G | Angular constraint with hinge (Gimbaled Roller) | |
| H | Angular constraint with hinge (Gimbaled Roller) | |
| TB (TURNBAR) | See FIGS. 3 and 4 | Tension Zone #2 |
| I | Zero constraint (Castered and Gimbaled Roller) | |
| J * | Angular constraint with hinge (Gimbaled Roller) | |
| K | Angular constraint with hinge (Gimbaled Roller) | |
| L | Angular constraint (Fixed Roller) | |
| M | Angular constraint with hinge (Gimbaled Roller) | |
| N | Angular constraint (outfeed drive roller) | |

Note:
Asterisk (*) indicates locations of load cells.

In this aspect of the present invention, load cells are provided in order to sense web tension at one or more points in the system. For example, load cells can be provided at gimbaled rollers D and J. Control logic for the respective digital printing system 50 monitors load cell signals at each location and, in response, makes any needed adjustments in motor torque or motor speed in order to maintain the proper level of tension throughout the system. For the aspects shown in FIGS. 2 and 5, the pacing drive component of the printing system is the turnbar module TB. In these aspects, there are two tension-setting mechanisms, one preceding and one following turnbar module TB. On the input side, load cell signals at roller D indicate tension of the web in tension zone #1 between the infeed drive roller B and the drive roller of the turnbar module TB; similarly, load cell signals at roller J indicate web tension on the output side, between turnbar module TB and outfeed drive roller N. Control logic for the appropriate in- and outfeed driver rollers at B and N, respectively, can be provided by an external computer or processor connected to the printing system 50. Optionally, an on-board control logic processor 90, such as a dedicated microprocessor or other logic circuit as shown in FIGS. 2 and 5, can be provided for maintaining control of web tension within each tension-setting mechanism and for controlling other machine operations and operator interface functions. The external computer or the on-board control logic processor 90 can be connected to memory or storage. As described, the tension in a tension zone preceding the turn bar and a tension zone following the turnbar module TB can be independently controlled relative to each other further enhancing the flexibility of the printing system. In the example aspects shown in FIGS. 2 and 5, the drive motor is connected to roller 32 and included in the turnbar module TB as shown in FIGS. 3 and 4. In other aspects of the present invention, the drive motor need not be included in a turnbar module. Instead, the drive motor can be appropriately located along the web path so that tension within one tension zone is independently controlled relative to tension in another tension zone.

An active steering mechanism can be used within a web span, such as where the web span length of an overhang exceeds its width resulting in the web no longer having sufficient mechanical stiffness for exact constraint techniques. This can happen, for example, where there is considerable overhang along the web span, that is, length of the web extending beyond the angular constraint for the span. This can be the case for modules 72 and 78 in the aspect of the invention described with respect to FIG. 5. In such a case, a castered roller in the overhang section of the web may no longer behave as a zero constraint, since some amount of lateral force from the web is needed in order to align the castered roller mechanism to the angle of the web span. This under-constraint condition, due to length of the overhang along this lengthy web span, is corrected by application of an additional constraint.

Kinematic connection between tension zones #1 and #2 follows the same basic principles that are used for exact constraint within each web span within the tension zones. That is, cross-track or edge alignment is taken from the preceding tension zone. Any attempt to re-register the print media edge as it enters the next tension zone would cause an over-constraint condition. Rather than attempting to steer the continuously moving print media through a rigid and over-constrained transport system, the print media transport components of the present invention self-align to the print media, thereby permitting effective registration at high transport speeds and reducing the likelihood of damage to the print media or mis-registration of applied ink or other colorant to the print media 28.

There are a number of ways to track web position in order to locate and position inkjet dots or other registration or alignment marks that are made on the print media 28. A variety of encoding and image-sensing devices can be used for this purpose along with the required timing and synchronization logic, provided by control logic processor 90 or by some other dedicated internal or external processor or computer workstation. Such encoders are typically placed just upstream of the print zone, and are preferably placed on a fixed roller so as to avoid interfering with the self aligning characteristics of castered or gimbaled rollers. The image-sensing devices are typically placed downstream of the print zone, capturing images of inkjet-dots or registration and alignment marks printed on the web.

Where multiple print stations are used within a tension zone corresponding to a print station module, as described with reference to the aspect shown in FIG. 5, it is desirable that the system have a master drive roller that can control the web transport speed through the multiple print stations. Multiple drive rollers can be used and can help to provide proper tension in the web transport (in-track) direction, such as by applying suitable levels of torque, for example. According to an aspect of the present invention, the turnbar (TB) module drive roller 32 can act as the master drive roller. The speed of the infeed drive roller at B in the tension zone corresponding to module 20 can be adjusted in response to a load sensing mechanism or load cell that senses web tension between the master drive and infeed rollers. Similarly, outfeed drive roller N can be controlled in order to maintain a desired web tension within the tension zone corresponding to second module 40.

In another aspect of the invention, the input equipment 110 can be a part of the tension zone corresponding to the first module instead of being isolated. Similarly, the output equipment can be a part of the tension zone corresponding to the second module. In these aspects, there is no need for the slack loop 52, which separates the input or output equipment from the tension zone, or tensioning mechanisms 24. A drawback of these aspects is that wobble in the supply or take-up rolls can directly translate into tension fluctuations on the web of print media in the tension zones.

In another aspect of the invention, due to the finite inertia of the drive rollers, tension fluctions on one side of a drive roller can influence the rotation of the drive roller, permitting some of the tension fluctuation to propagate past the drive roller into the next tension zone. Increasing the inertia of the drive roller or providing additional compliance or stretchability to the web of print medium 28 can act as low pass filter to reduce the propagation of tension fluctuations from one tension zone to another. Inertia of a roller can be increased by using a larger diameter roller, a heavier material for the roller, or by increasing the inertia of the drive motor.

Figure 6:
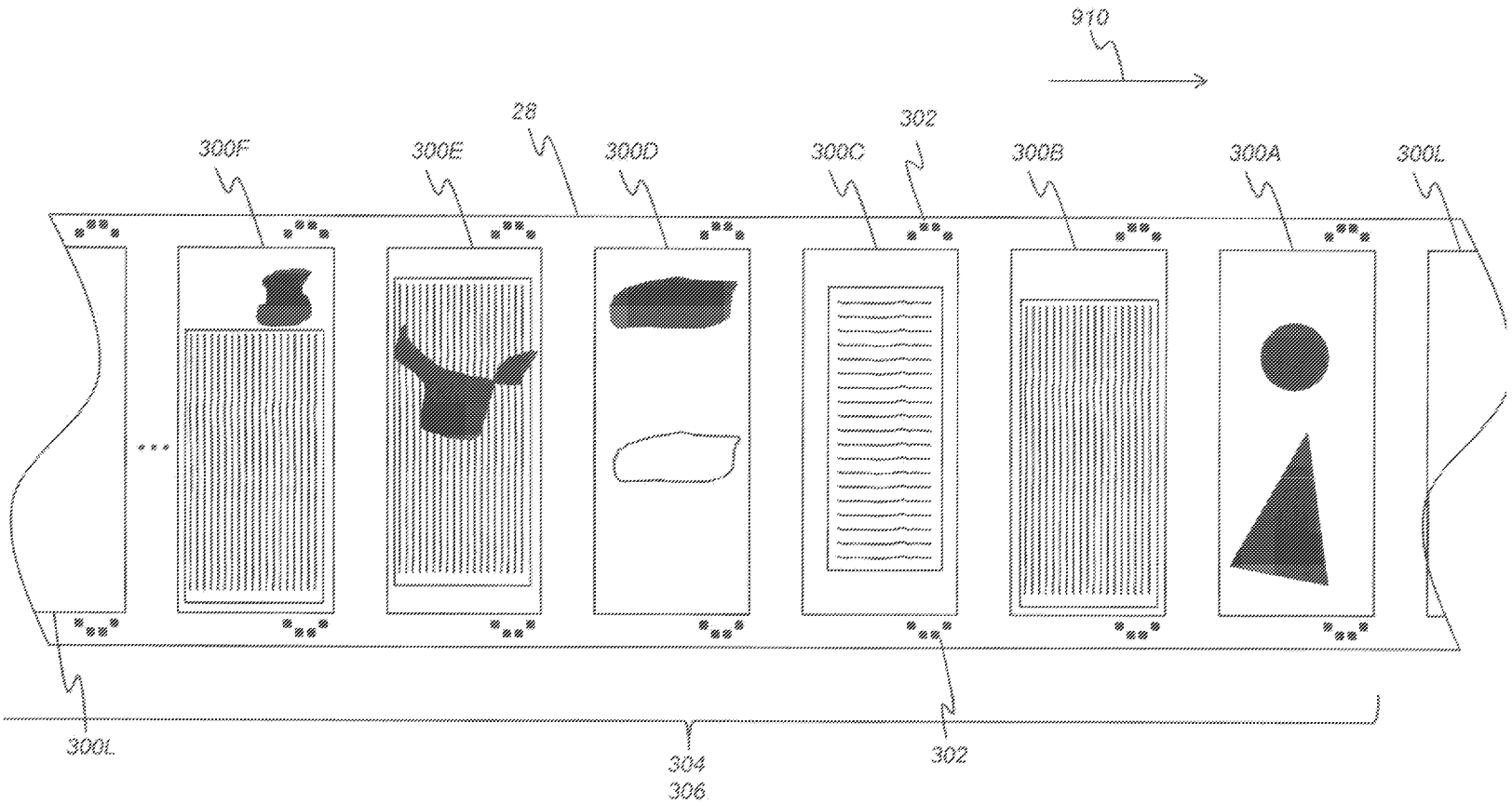
FIG. 6 shows a portion of the print media on which one copy of a print job is printed.

FIG. 6 shows a portion of a continuous web of print media 28 with multiple copies of a print job 306 printed on the print media 28. Each copy of the print job 306 includes a sequence 304 of documents 300A to 300L. For each copy of the print job, the documents of the sequence are printed in the same order. Each time the print job is printed on the web of print media 28, the first document 300A of one copy is preceded by the last document 300L of the previous copy of the print job. Also printed on the print media are registration patterns consisting of marks printed by each of the print stations, which enable the registration of the different image planes to be measured. One or more registrations patterns can be associated with each document. Alternatively the registration patterns can be printed at a uniform spacing along the web of print media 28, where the spacing of the registration patterns is different from the spacing of the documents on the web. Preferably, the spacing of the registration patterns is less than the spacing of the documents along the web, such that there is at least one registration pattern for each document spacing interval.

Figure 6B:
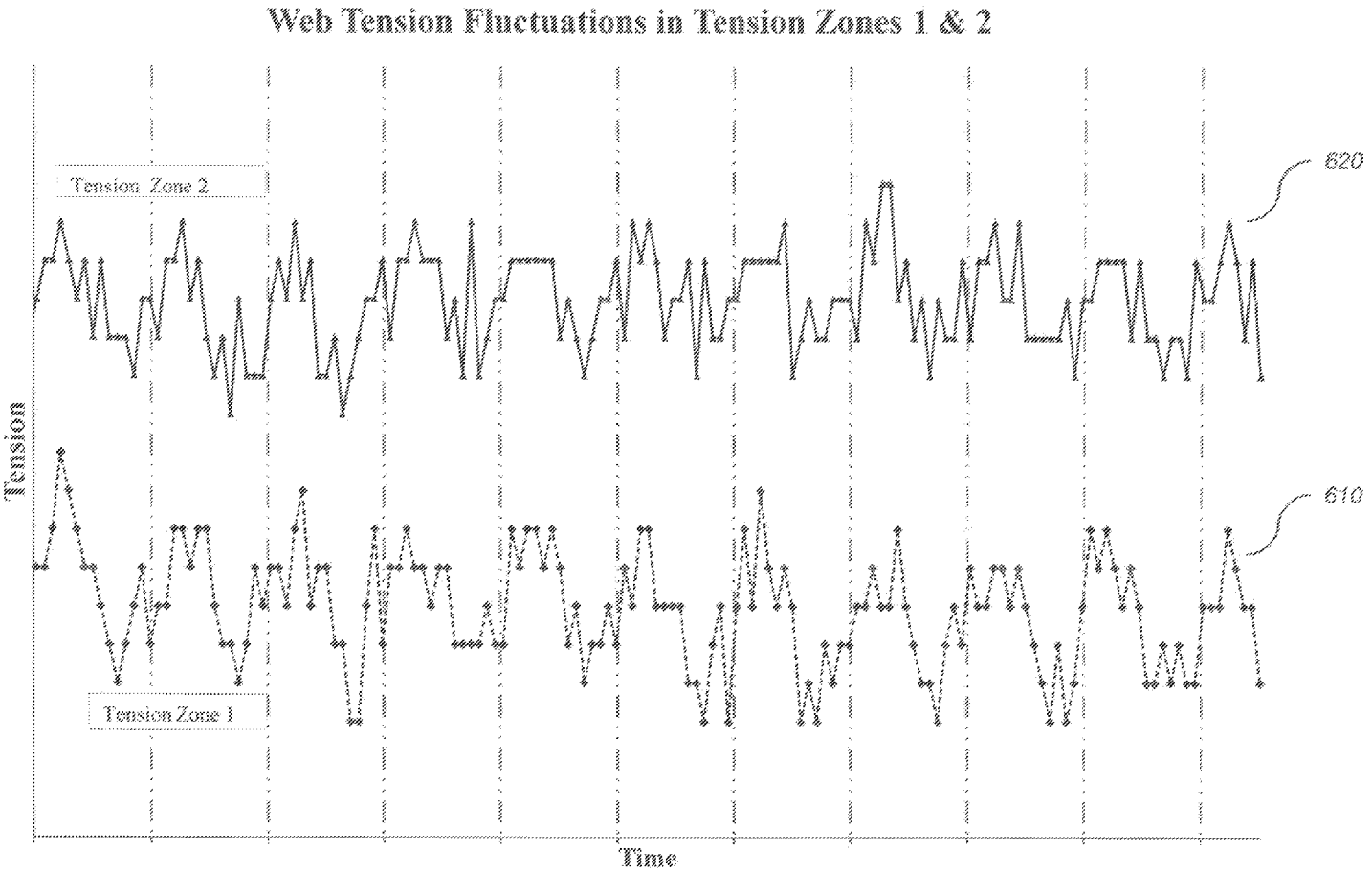
FIG. 6B shows the fluctuations of the web tension produced by printing copies of a print job

FIG. 6B shows tension fluctuations 610 and 620 on a web of print media 28 in tension zones 1 and 2 during the printing of multiple copies of a print job. Each document within the sequence of documents can have an ink coverage profile that is significantly different from the other documents in the sequence of documents.

Inkjet printing, through its application of ink to the print media 28, can alter the mechanical properties of the print media to change. Water-based inks, when applied to cellulose-based print media, can cause the fibers of the print media to expand, and the fiber to fiber bonds to be altered making the print media selectively applies ink, typically a water based ink, can cause the elastic modulus of the print media to drop, making the print media less stiff. As different documents of the print job have different ink coverage levels, the elastic modulus of the print media can fluctuate significantly from document to document. As a result of these variations in elastic modulus the web tension can fluctuate as the print media passes through the tension zones of the printing system. FIG. 6B shows plots 610 and 620 of the web tension in tension zone 1 as measured by the load cell of roller D and the web tension in tension zone 2 as measured by the load cell of roller J. The horizontal axis corresponds to time. The tension plot 620 for tension zone 2 has been shifted vertically so that the two plots don't overlap providing easier readability.

The spacing of the vertical grid lines corresponds to printing each of individual copies of the print job. It is clear that the tension in the web fluctuates in a periodic manner in response to repeatedly printing the sequence of documents that make up the print job. These periodic fluctuations in web tension can lead to undesirable periodic fluctuations in color to color registration. The periodic web tension fluctuations can also lead to tension control stability problems as the servo control for web tension tries to correct for such tension fluctuations.

Commonly-assigned U.S. Patent Publication No. 2013/0286071 by Armbruster et al., which is herein incorporated by reference in its entirety, discloses a method for performing color-to-color correction while printing multiple copies of a print job having one or more documents where the method includes printing one or more copies of the print job and determining at least one color registration error for at least one type of color registration error produced during the printing of the one or more copies of the print job. The color registration errors are determined by comparing each color plane to a reference color plane, and the color registration errors can be produced by one or any combination of registration error types: color plane translation, color plane rotation, and color plane stretch or contraction in each of the in-track and cross-track directions. These registration errors can be measured by using an image sensor, which captures an image of test marks printed by the various print stations, as described in U.S. Pat. No. 8,104,861.

It can be seen that the method of the present invention can be applied for handling continuous web of print media transport within and between one, two, three, or more print stations within a the tension zone corresponding to module, applying exact constraint techniques. This flexibility permits a web transport arrangement that provides effective registration and repeatable performance at high speeds commensurate with the requirements of high-speed color inkjet printing. As has been shown, multiple print stations can be integrated into a module, and multiple modules can be integrated to form a printing system, without the requirement for painstaking alignment of rollers or other media handling components within the tension zone or at the interface between two tension zones.

Figure 7:
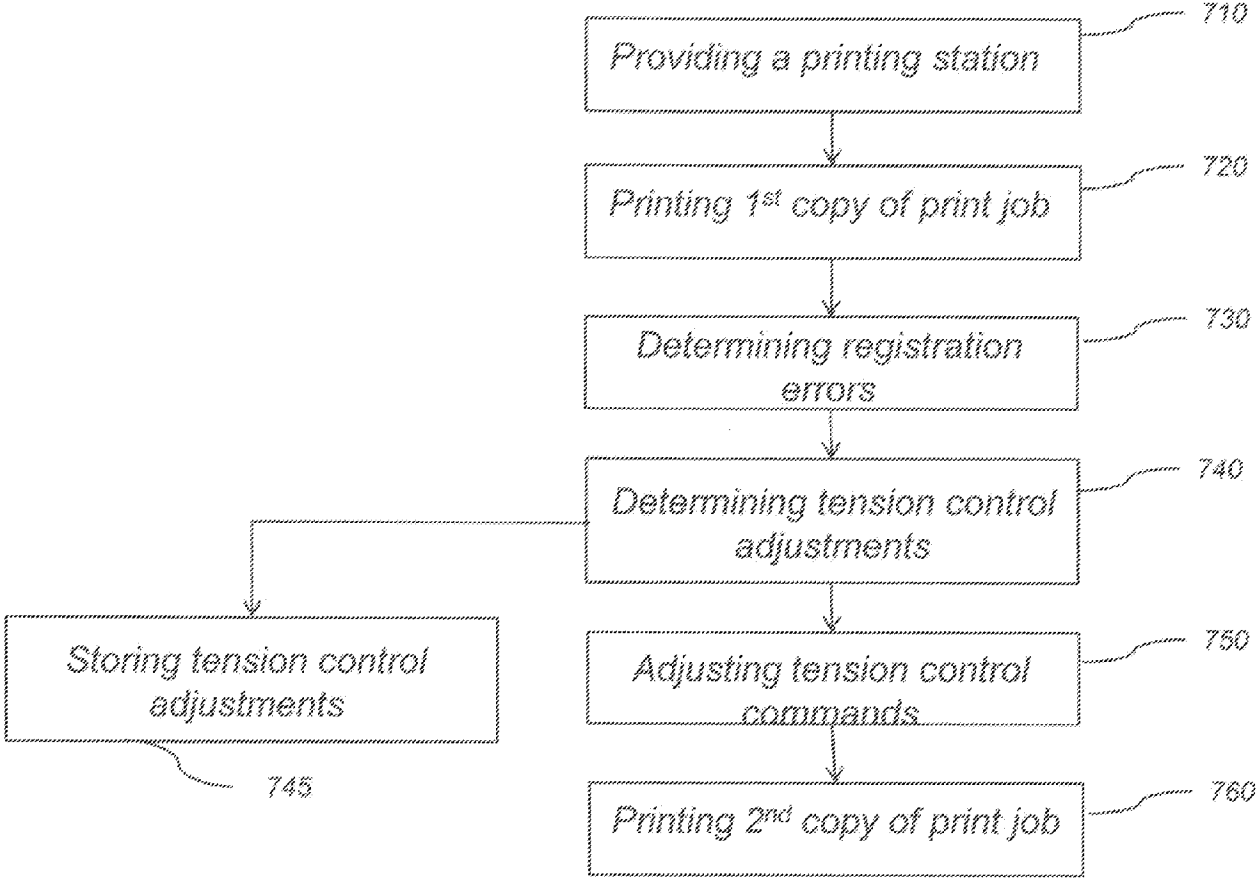
FIG. 7 shows a flowchart for a method for reducing registration errors according to an aspect of the present invention.

FIG. 7 shows a flowchart for a method for using tension control adjustments to reduce registration errors while printing multiple copies of a print job according to an aspect of the invention. As well known in the art, the steps of the method shown in the flowchart of FIG. 7 can be performed by an external processor or computing device in communication with on-board memory or external storage or by the on-board control logic processor 90 having associated memory or storage. In step 710, a printing system is provided. The printing system has at least one print station disposed opposite a first side of a web, the print station defining one or more print zones where a liquid is deposited onto the first side of the web. The printing system also includes one or more rollers adapted to receive tension control commands. In some aspects of the invention, these rollers can be drive rollers such as the infeed drive roller, the outfeed drive roller, or the turnbar roller. In other aspects of the invention, these rollers adapted to receive tension control commands can be braking rollers which apply a drag force on the moving web. In still other aspects of the invention, these rollers adapted to receive tension control commands can be dancer rollers that are actively positioned in response to tension control commands. In still other aspects of the invention, these roller can be rollers that alter the steering or spreading of the print media. The printing system is partitioned into one or more tension zones, each tension zone defining a portion of the media path including one or more web spans over which tension of the print media is separately controlled. Typically a drive roller serves as the boundary between two tension zones; one tension zone upstream of the drive roller and a second tension zone downstream of the drive roller. The tension zones can include supply and take-up rolls, print stations, and turnbar modules.

The tension control commands operate on the rollers to control the amount of tension of print media in each tension zone of the printing system independently of the other tension zones as it moves through the print zone. In Step 720, a first copy of the print job is printed using the print stations in the printing system. In Step 730, a plurality of registration errors produced during the printing of the first copy of the print job is determined. In Step 740, first tension control adjustments are determined for each tension zone corresponding to a print station module based on the plurality of registration errors. In Step 745, the first tension control adjustments are stored in processor-accessible memory for printing subsequent print jobs. In Step 750, the first tension control adjustments are used to adjust the tension control commands to the one or more rollers in each tension zone in the printing system. In some aspects of the present invention, tension measurements can also be taken in the supply and take up roll assemblies and tension control adjustments computed and stored for these tensions zones as well. In Step 760, a second copy of the print job is printed using the printing system.

In some aspects of the present invention, the tension control adjustments can be represented using a functional notation instead of adjustment values. Actual adjustments to the tension can be computed from the functional notation. It is obvious to one skilled in the art that there are multiple ways of representing tension control adjustments.

Figure 8:
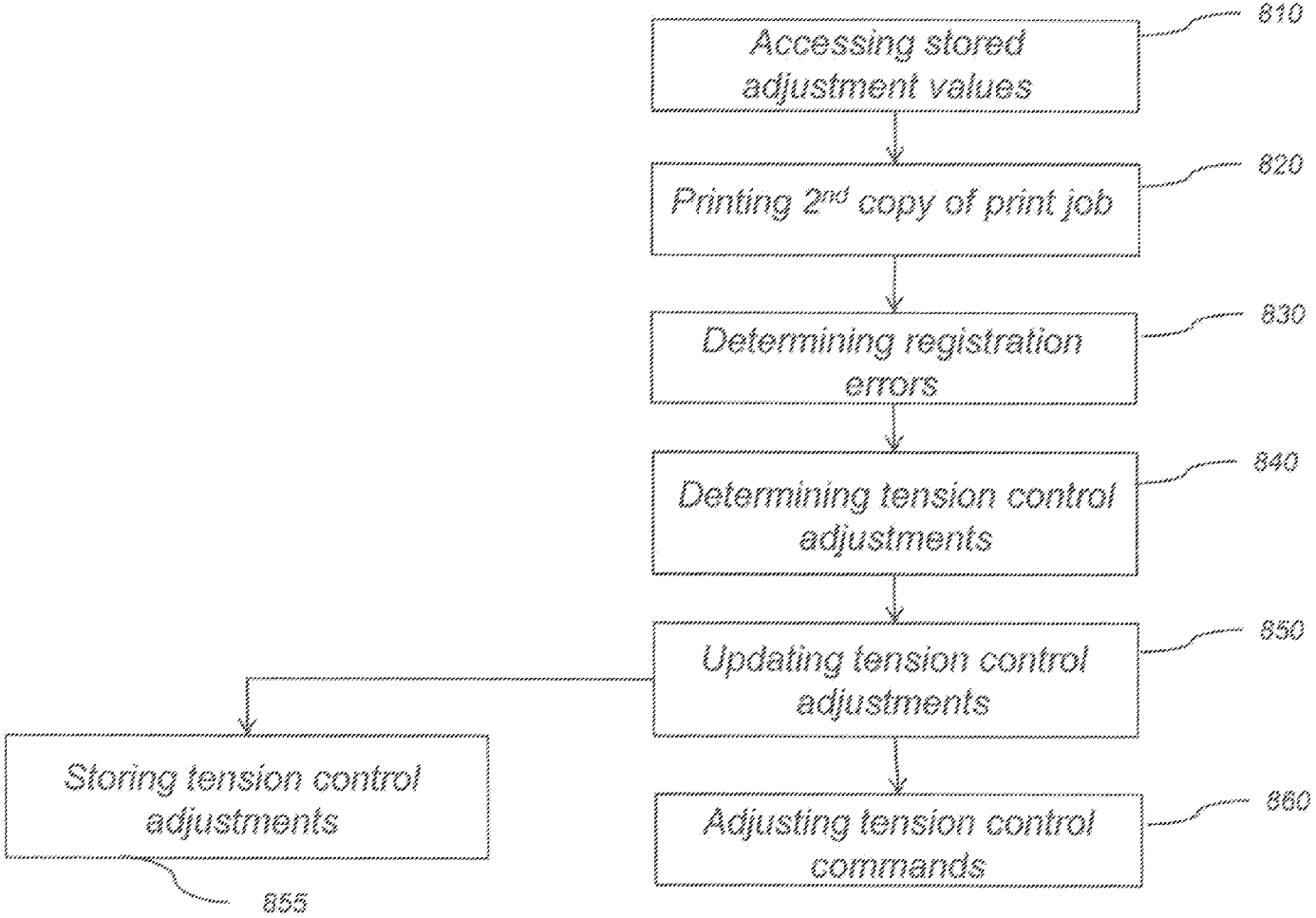
FIG. 8 shows a flowchart for a method for reducing registration errors according to another aspect of the present invention.

FIG. 8 shows a flowchart for a method for printing according to another aspect of the present invention. In Step 810, the stored first tension control adjustments are accessed from the processor-accessible memory or storage device. In Step 820, a second copy of the print job is printed using the stored first tension control adjustments to adjust the tension control commands sent to the one or more rollers corresponding to each tension zone in the printing system. In Step 830, at least one registration error produced during the printing of the second copy of the print job is determined. In Step 840, second tension control adjustments for each registration error produced during the printing of the second copy of the print job are computed. In Step 850, the stored tension control adjustments are updated using the respective second tension control adjustments associated with the printing of the second copy of the print job. This can be done using mathematical techniques well known in the art such as averaging the first and second tension control adjustments to produce updated tension control adjustments. Alternately, the second tension control adjustments can replace the stored tension control adjustments. The first and second tension control adjustments can be weighted differently to assign preference to one or the other. For example, the first stored tension control adjustments can be given 25% weight and the second tension control adjustments can be given 75% weight. This permits the system to rely more on the newest computed adjustments but reduces the likelihood of rapidly switching back and forth between different tension control adjustments determined from printing multiple copies of the print job.

In Step 855, the updated tension control adjustments are stored in processor-accessible memory for printing subsequent print jobs. In Step 860, the updated stored tension control adjustments are used to adjust the tension control commands to the one or more first rollers of each of the tension zones in the printing system when printing a subsequent copy of the print job. The steps of the method shown in FIGS. 7 and 8 can be performed periodically or non-periodically to update each stored tension control adjustment when printing multiple or subsequent copies of the print job.

In another aspect of the present invention, the first tension control adjustments can also be determined based on an ink load printed on the print media, in combination with the determined registration errors. Higher ink load produced by laydown of more ink on the web can produce more expansion of the print media than a lower ink load.

According to another aspect of the invention, the first tension control adjustments are determined as a profile for each page of a document in the print job. In this aspect, an individual tension adjustment value is determined for each page in the print job. A profile of the individual tension adjustment values for all the pages in the print job can then be produced and used to determine the first tension control adjustments. This profile can be a discrete set of tension control parameter numbers for each page. Well known mathematical functions can also be used to "smooth" the profile to reduce abrupt changes in tension in the print media.

Figure 9A:
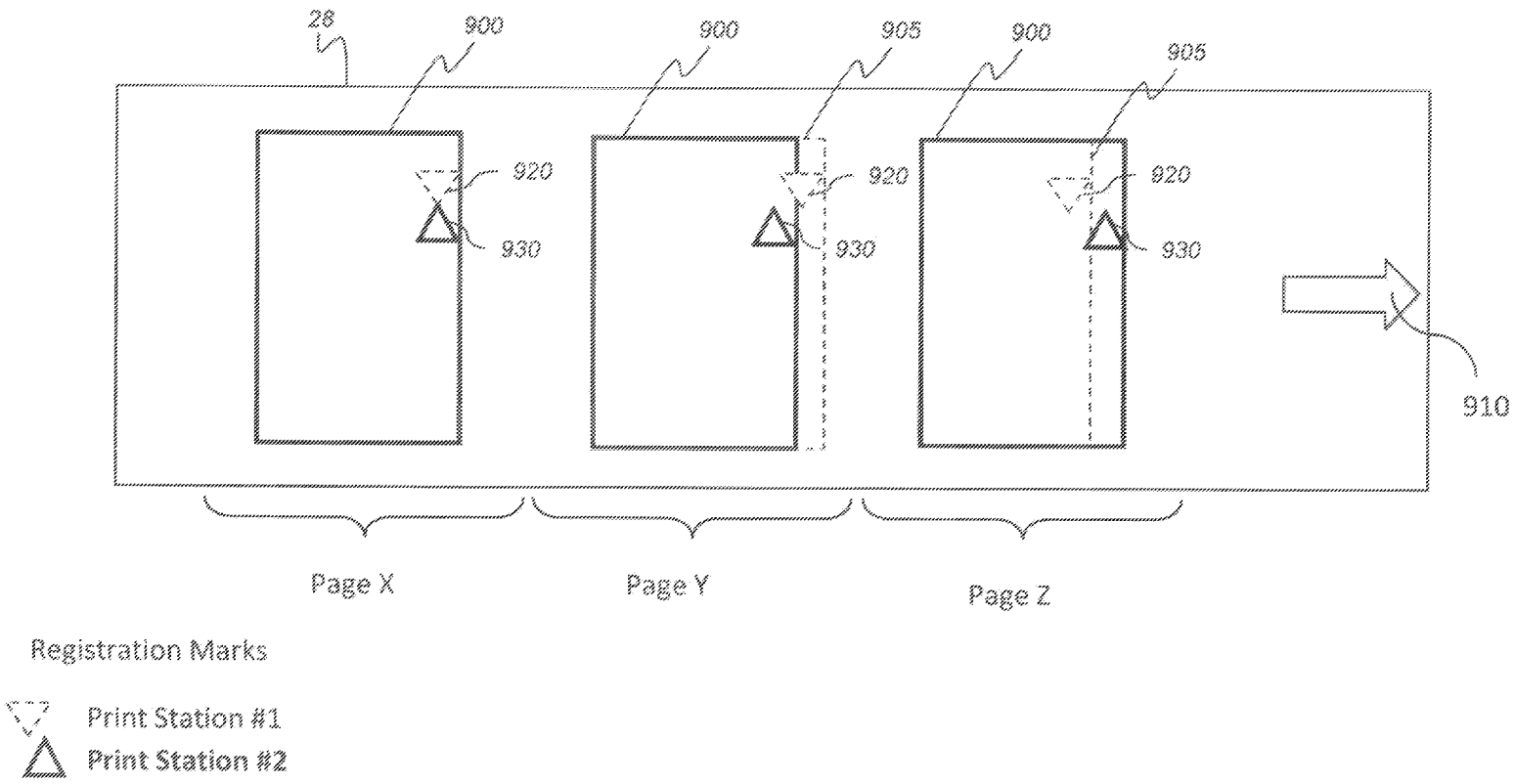
FIG. 9*a* shows examples of registration errors in the in-track direction according to an aspect of the present invention.

According to one aspect of the present invention, the tension control adjustments are based on the registration errors. A higher tension correction signal is computed to correct for a registration error corresponding to a lower tension measurement in the printing system. A lower tension correction signal is computed to correct for a registration error corresponding to a higher tension measurement in the printing system. Each printing station in the printing system can print registration marks on the print media 28. FIG. 9A shows examples of registration marks 920 and 930 printed on the print media 28 by two print stations on three different page regions 900 of the print job. These marks correspond to registration errors in the in-track direction due to expansion or contraction of the web in the in-track direction. Arrow 910 indicates the direction of web movement through the printing system.

As shown on page X of FIG. 9A, the registration mark 920 printed by the first print station on the page region 900 and the registration mark 930 printed by the second print station on the page region 900 are aligned with respect to each other, implying that the web is in a steady tension state and the print media is appropriately aligned with the printheads in the print zones. In this case, no adjustments to the steady tension state are required. On page Y, the registration mark 920 printed by print station 1 is to the right of the registration mark 930 printed by print station 2. This corresponds to an expansion of a portion of the web including page region 900 corresponding to page Y between print station 1 and print station 2. The edge of expanded page Y as it passes through print station 2 is shown as the dashed line 905. To reduce the registration error by reducing the in-track expansion, the tension control adjustment value for page Y is set to lower the tension to a level lower than the normal value. This translates into tension control commands for the first rollers to decrease the tension in the web of print media in the print zone of print station 2, thus reducing the misalignment distance between the two registration marks. Since the tension is achieved by a differential speed between the infeed drive roller and the master drive roller in the turnbar, the speed of the infeed drive roller is slightly increased, reducing the relative speed difference of the infeed roller with respect to the master drive roller in the turnbar to decrease the tension in the print zone. The tension control adjustment values can be computed using well known mathematical methods. As an example, a look-up-table can be produced for tension control adjustment values based on the measured distance between the marks. A smaller distance between registration marks requires a smaller adjustment value than a larger distance between registration marks. Instead of a look-up-table, the above relationship can also be represented using a function of distance versus adjustment value.

On page Z, the registration mark 920 printed by print station 1 on page region 900 is to the left of the registration mark 930 printed by print station 2. This corresponds to a contraction of a portion of the web corresponding to page Z between print station 1 and print station 2. The edge of contracted page Z as it passes through print station 2 is shown as the dashed line 905. To reduce the registration error, the tension control adjustment value for page Z is set to raise the tension to a higher value than the normal value. This translates into tension control commands for the first rollers to increase the tension on the web of print media in the print zone of print station 2, thus reducing the misalignment distance between the two registration marks. Since the tension is achieved by a differential speed between the infeed drive roller and the master drive roller in the turnbar, the speed of the infeed drive roller is slightly decreased, increasing the speed difference of the infeed roller with respect to the master drive roller in the turnbar to decrease the tension in the print zone.

Figure 9B:
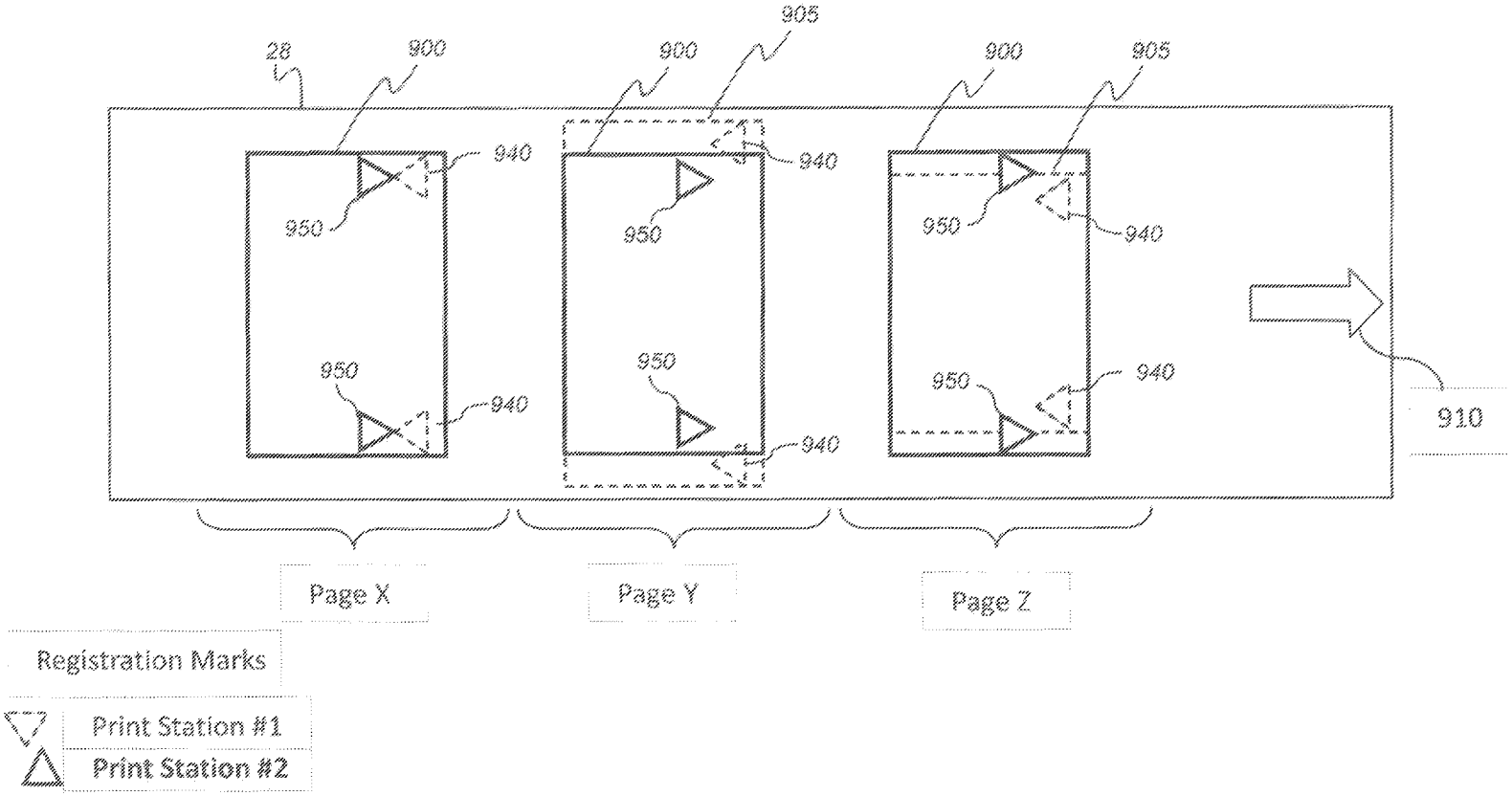
FIG. 9*b* shows examples of registration errors in the cross-track direction according to an aspect of the present invention.

FIG. 9B shows examples of printing two registration marks 940 and 950 on the print media 28 by each of two print stations on three different pages regions 900 of the print job. The relative placements of these marks are used to identify registration errors in the cross-track direction due to cross-track wandering of the web or to the expansion or contraction of the web in the cross-track direction. Arrow 910 indicates the direction of web movement through the printing system.

As shown on page X of FIG. 9B, the two registration marks 940 and 950 printed by the first and second print stations are aligned with respect to each other, implying that the web is in a steady tension state and the alignment of the print zones to each other corresponds to the cross-track placement of the web of print media travelling between the print stations. In this case, no adjustments to the steady tension state are required. On page Y, the registration marks 940 printed by print station 1 are outside (farther from the centerline of the print media 28) of the registration marks 950 printed by print station 2. This corresponds to an expansion of a portion of the web corresponding to page Y in the cross-track direction, as shown by the dashed line 905, between print station 1 and print station 2 in the cross-track direction. In some aspects of the invention, cross-track expansion or contraction shifts are compensated for by changes in the in-track tension via the Poisson's ratio of the print media. Due to the positive Poisson's ratio of the print media, an increase in the stretch of the print media in the in-track direction causes the print media to contract in the cross-track direction, while a decrease in the stretch of the print media in the in-track direction causes the print media to expand in the cross-track direction. To reduce the registration error caused by the expansion of page Y, the tension control adjustment value for page Y is set to increase the tension to a higher than the normal value. This translates into tension control commands for the first rollers to increase the tension on the web of print media in the print zone of print station 2, reducing the misalignment distance between the two registration marks by stretching the print media in the in-track direction to reduce its cross-track expansion. Since the tension is achieved by a differential speed between the infeed drive roller and the master drive roller in the turnbar, the speed of the infeed drive roller is slightly decreased with respect to the drive roller in the turnbar to increase the in-track tension in the print zone. The tension control adjustment values can be computed using well known mathematical methods. As an example, a look-up-table can be produced for tension control adjustment values based on the measured distance between the marks. A smaller distance between registration marks requires a smaller adjustment value than a larger distance between registration marks. Instead of a look-up-table, the above relationship can also be represented using a function of distance versus adjustment value.

On page Z, the registration marks 940 printed by print station 1 are on the inside (closer to the centerline of the print media 28) of the registration marks 950 printed by print station 2. This corresponds to a contraction of a portion of the web corresponding to page Z, as shown by the dashed line, between print station 1 and print station 2 in the cross-track direction, resulting in a higher tension in the web of print media. To reduce the registration error caused by the cross-track contraction of the print media, the tension control adjustment value for page Z is set to lower the in-track tension to a level lower than the normal value. This translates into tension control commands for the first rollers to decrease the tension on the web of print media in the print zone of print station 2, thus reducing the misalignment distance between the two registration marks by reducing the tension in the in-track direction to increase its cross-track expansion. Since the tension is achieved by a differential speed between the infeed drive roller and the master drive roller in the turnbar, the speed of the infeed drive roller is slightly increased, reducing the speed difference of the in-feed drive roller with respect to the drive roller in the turnbar to decrease the in-track tension in the print zone.

FIGS. 9A and 9A show simplified versions of the registration errors corresponding to dimensional changes of portions of the web only in the in-track or cross-track directions respectively. The dimensional changes of the print media can occur in both the cross-track and the in-track direction simultaneously. These dimensional changes in cross-track and in-track direction are, in general, non isotropic: for one, the print media is conveyed past the various print stations under tension applied by the web transport in the in-track direction, for another, the support can be manufactured intentionally anisotropic (for example pre-tensilized PET) to counteract the tension applied by the conveyance system during printing. The registration marks printed by print station 1 and print station 2 can be offset from each other by both an in-track separation and a cross-track separation. The tension control adjustments can be computed to account for both of these registration errors at the same time or separately.

In some aspects of the invention, the print media is paper or other substrate where the printing system prints the print job using color separations. In these aspects, the registration errors are color-to-color registration errors between the color separations printed by the printing stations. In other aspects of the present invention, the print media is a substrate for a multi-layered electrical circuit where the printing system prints the print job using conductive, insulating, or protective separations. In these aspects, the registration errors are alignment errors between the printed separations. Also, in the case of printed multi-layer electrical circuits, the jetting modules in each print station jet only electrically conductive inks, electrically insulating inks or inks to form protective coatings for the electrical circuit.

Figure 10:
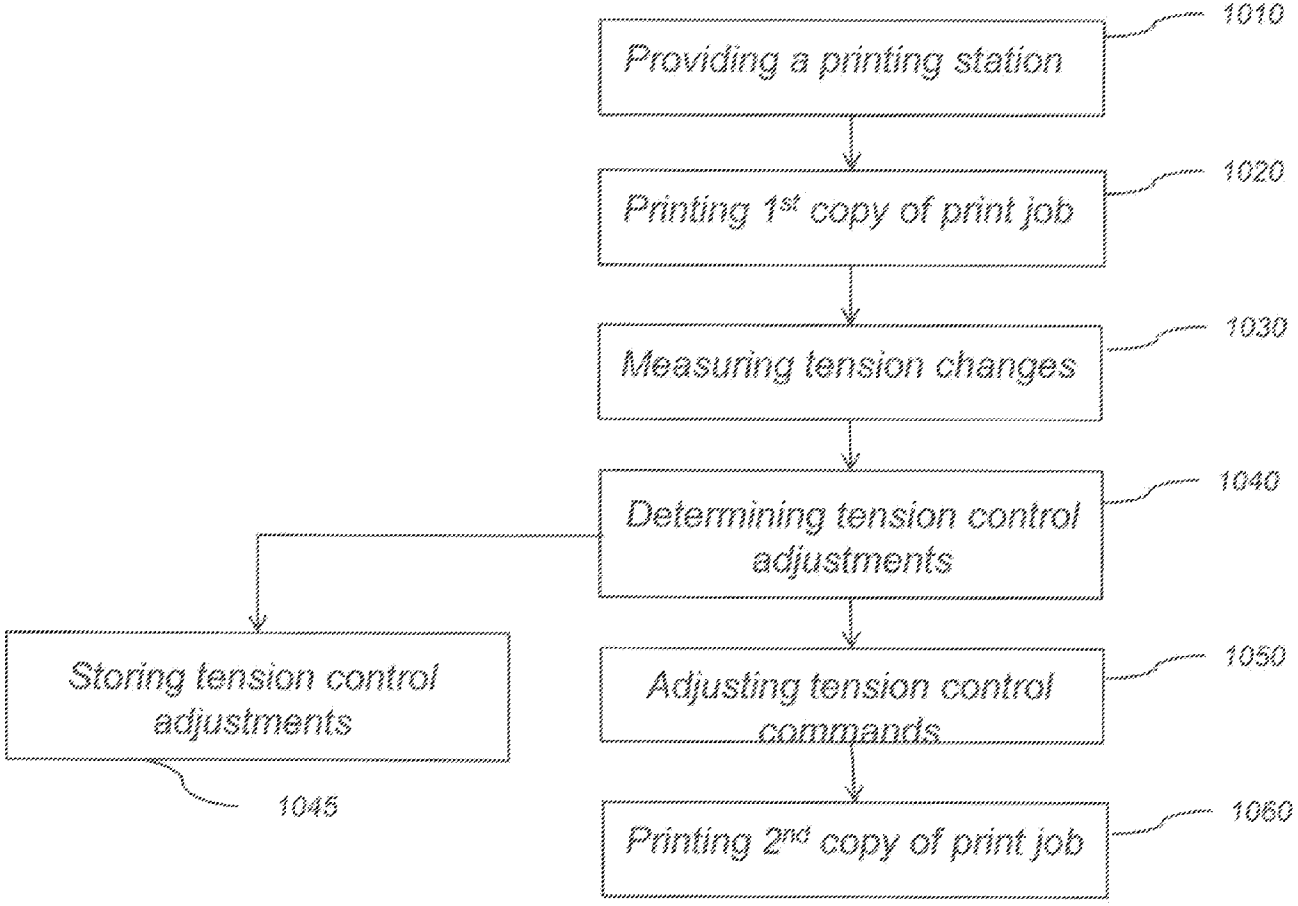
FIG. 10 shows a flowchart for a method for reducing registration errors according to an aspect of the present invention.

FIG. 10 shows a method for reducing tension fluctuations while printing multiple copies of a print job according to another aspect of the invention. As well known in the art, the steps of the method shown in the flowchart of FIG. 10 can be performed by an external processor or computing device in communication with on-board memory or external storage or by the on-board control logic processor 90 having associated memory or storage, in the printing system. In step 1010, a printing system is provided. The printing system has at least one print station disposed opposite a first side of a web, the print station defining one or more print zones where a liquid is deposited onto the first side of the web. The printing system also includes one or more rollers adapted to receive tension control commands. In some aspects of the invention, these rollers are drive rollers such as the infeed drive roller, the outfeed drive roller, or the turnbar roller.

The tension control commands operate on the rollers to control the amount of tension of print media in the printing system as it moves through the print zone. In Step 1020, a first copy of the print job is printed using the print stations in the printing system. In Step 1030, tension changes produced during the printing of the first copy of the print job are measured. In Step 1040, first tension control adjustments for each tension zone are determined based on the measured tension changes on the web span in each tension zone. In Step 1045, the first tension control adjustments are stored in processor-accessible memory for printing subsequent print jobs. In Step 1050, the first tension control adjustments are used to adjust the tension control commands to the one or more rollers corresponding to the tension zones in the printing system. In Step 1060, a second copy of the print job is printed using the printing system.

Figure 11:
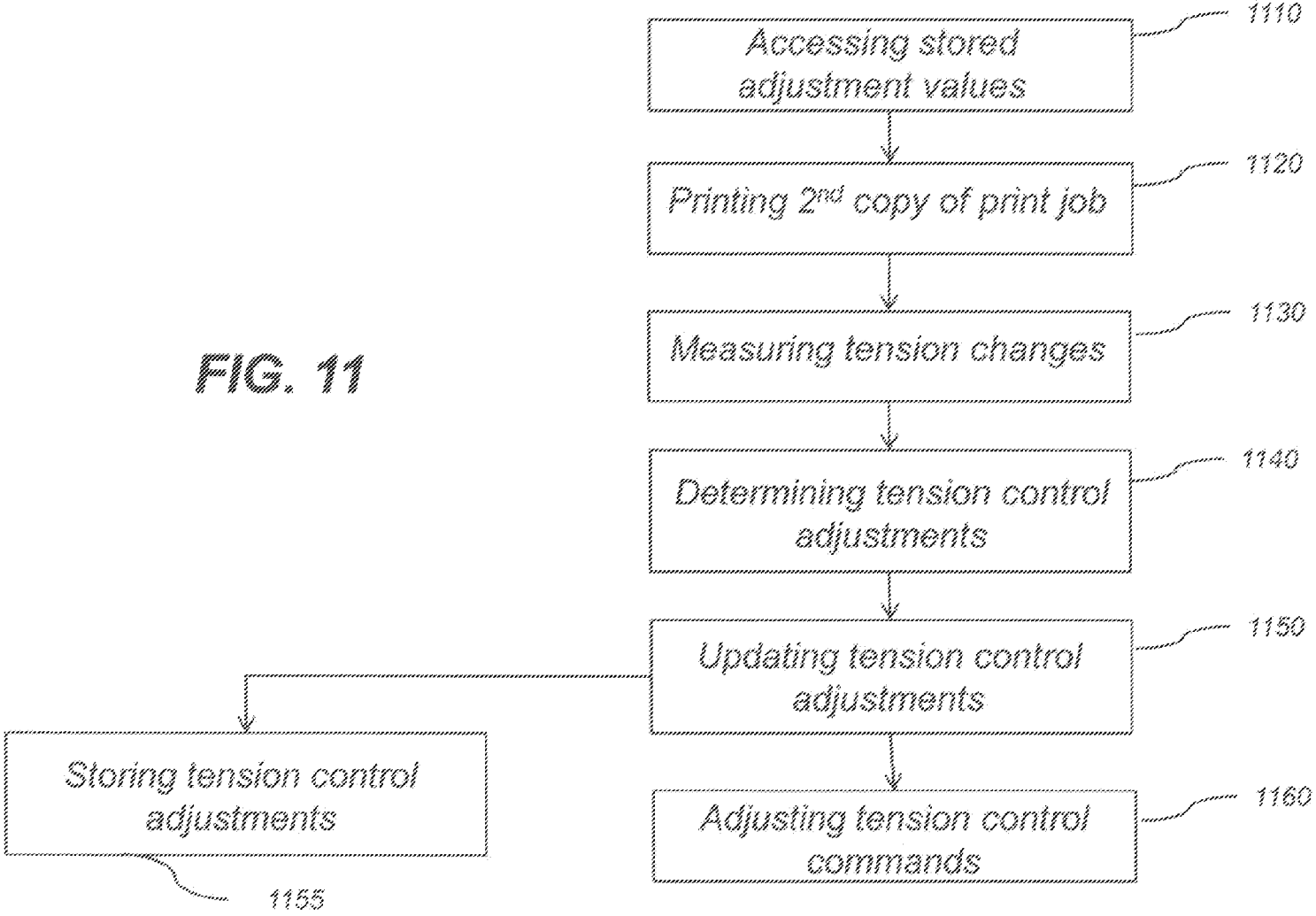
FIG. 11 shows a flowchart for a method for reducing registration errors according to another aspect of the present invention.

FIG. 11 shows a flowchart for a method for printing according to another aspect of the present invention. In Step 1110, the stored first tension control adjustments for each tension zone are accessed from the processor-accessible memory or storage device. In Step 1120, a second copy of the print job using the stored first tension control adjustments to adjust the tension control commands sent to the one or more rollers corresponding to the tension zones in the printing system. In Step 1130, tension changes produced in each of the tension zones during the printing of the second copy of the print job are measured. In Step 1140, second tension control adjustments for each registration error produced during the printing of the second copy of the print job are computed. In Step 1150, the stored tension control adjustments for each tension zone are updated using the respective second tension control adjustments associated with the printing of the second copy of the print job. This can be done using mathematical techniques well known in the art such as averaging the first and second tension control adjustments to produce updated tension control adjustments. The first and second tension control adjustments can be weighted differently to assign preference to one or the other. For example, the first stored tension control adjustments can be given 25% weight and the second tension control adjustments can be given 75% weight. This permits the system to rely more on the newest computed adjustments but reduces the likelihood of rapidly switching back and forth between different tension control adjustments determined from printing multiple copies of the print job.

In Step 1155, the updated tension control adjustments are stored in processor-accessible memory for printing subsequent print jobs. In Step 1160, the updated stored tension control adjustments are used to adjust the tension control commands to the one or more first rollers corresponding to the tension zones in the printing system when printing a subsequent copy of the print job. The steps of the method shown in FIGS. 10 and 11 are performed periodically or non-periodically to update each stored tension control adjustment when printing multiple or subsequent copies of the print job.

In these aspects of the invention, controlling the tension in the print media at a steady state is desirable for ensuring proper registration of separations printed by the print stations on the web. By isolating various portions of the printing system into separate tension zones, the tension within each portion can be controlled independently of tension fluctuations or variations in other tension zones in the printing system. The web undergoes wetting and drying in the printing system, which can result in expansion or contraction of the web. In one aspect of the present invention, the registration errors from the expansion and contraction of the web can be reduced by digital alteration of the printed separations to account for the deformations in the web. Changes in the tension of the web can negatively impact this digital correction. Changes in the tension in the web can also cause the formation of folds or wrinkles in the web of print media. The method of FIGS. 10 and 11 provide significant advantage in reducing tension fluctuations in the web and maintaining it at a steady state for printing multiple separations and aligning them properly. Isolating components of the printing system into multiple tension zones permits the tension to be controlled in each tension zone independent of the other tension zones. This can result in a much simpler tension control system, as tension fluctuations in other tension zones do not impact the tension control adjustments in a particular tension zone. Controlling the tension in the web can also reduce the formation of folds or wrinkles in the web due to deformations from wetting and drying of the web.

In these aspects of the invention, a higher tension correction signal is computed to correct for a lower tension measurement in the printing system. Similarly, a lower tension correction signal is computed to correct for a higher tension measurement in the printing system.

Figure 12:
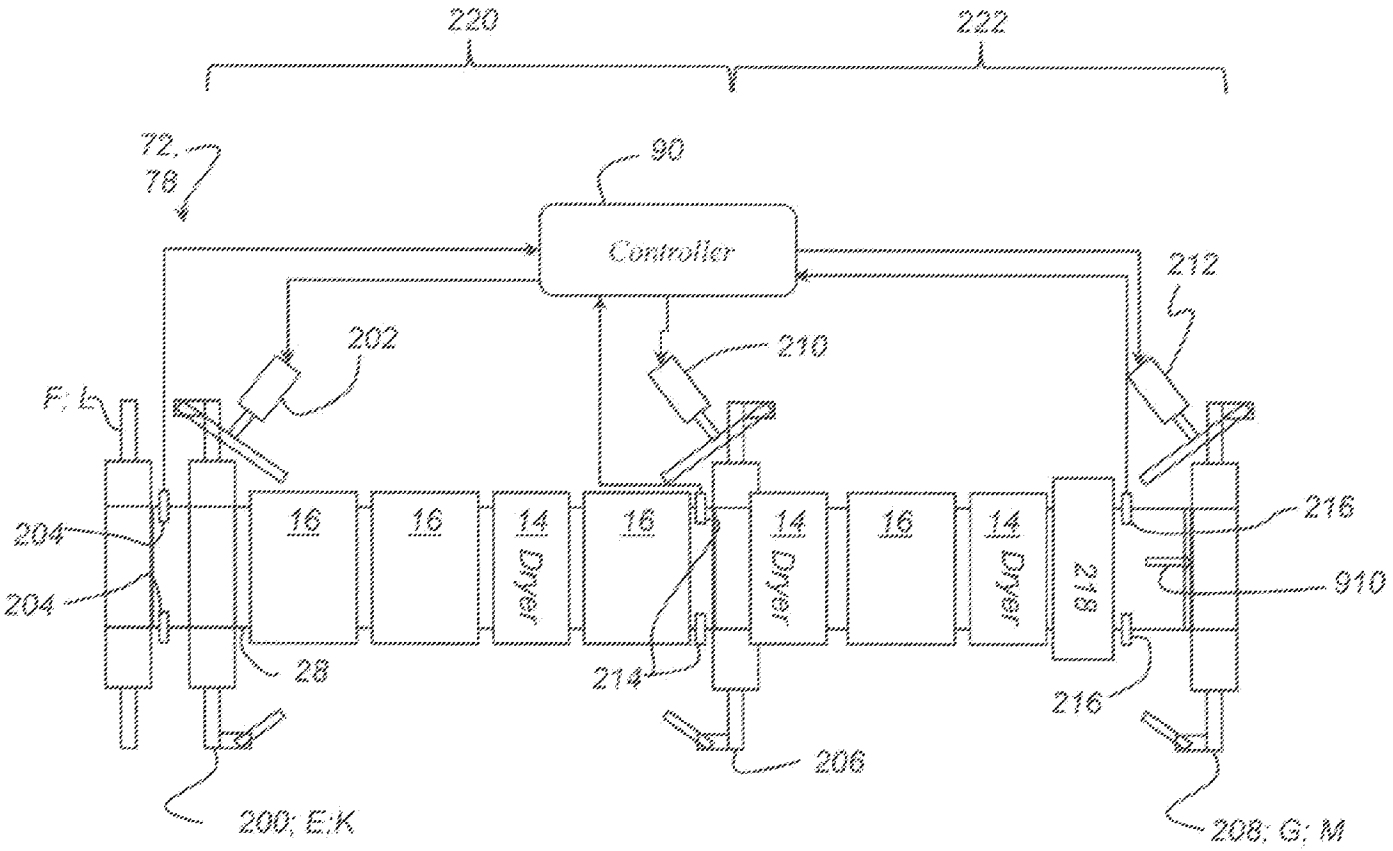
FIG. 12 shows of top view of a print station module having steering rollers to guide the print web.

According to some aspects of the invention, the measurements of the web tension can comprise measurements of a tension gradient or difference across the width of the print media. In such systems, the tension control commands send by the control logic processor 90 to one or more rollers to control the amount of tension of the web can comprise commands to control the tension gradient or difference across the width of the print media. In another aspect of the invention, the printing system includes one or more systems to alter the tension gradient across the print media to thereby steer the print media and alter its cross-track position. These tension gradient altering systems can comprise rollers that are steered to change the orientation of the axis of a roller relative to cross-track direction. FIG. 12 shows a top view of a printing station module 72 or 78 in which the print media 28 is guided under a plurality of print stations 16 and dryers 14. In this aspect of the invention, the print media is actively steered by a castered roller 200 as the print media approaches the first print station 16 (on left). The castered roller 200 location corresponds to roller E or roller K of FIG. 5. Actuator 202 drives the castered roller in response to signals from control logic processor 90. The steering commands from the control logic processor 90 are based in part on signals from edge detectors 204 which determine the cross-track position of the print media 28 downstream of the castered roller 200. Second and third castered rollers 206 and 208 respectively can be steered by actuators 210 and 212 under the control of control logic processor 90. The portion of the web path between the first castered roller 200 and the second castered roller 206 constitutes a first tension gradient zone 220 and the portion of the web path between the second castered roller 206 and the third castered roller 208 constitutes a second tension gradient zone 222. The controller can control the steering of the castered rollers 206 and 208 in response to cross-track position measurements by edge sensors 214 and 216. Additionally the printing system can be adapted to print a first copy of a print job on the web of print media 28. The print job can include a sequence of documents to be printed on one or both sides of the print media. An imaging system 218, such as a camera or a linear sensor array, is used to capture images of the pattern printed on the print media. From the captured images, a plurality of registration errors of the printed images can be determined, typically by the controller 90. Based on the plurality of registration errors, the processor 90 can determine tension control adjustments for the second and third castered rollers 206 and 208. As subsequent copies of the print job are printed, the controller applies the tension control adjustments determined from the printing of the first copy of the print job by way of tension control commands to the actuators of the second and third castered rollers to thereby alter the cross-track positioning of the print media and thereby reduce the registration errors. Preferably images are captured, with subsequent determination of registration errors and tension control adjustments, at a rate of one or more images and control adjustments being made per document in the sequence of documents of the first copy of the print job. During the printing of subsequent copies one or more tension control adjustments are applied to the castered rollers 206 and 208 for each document in the sequence of documents that make up a print job. In this manner registration errors can be reduced for each document in copies of the print job printed after the first copy.

Figure 13:
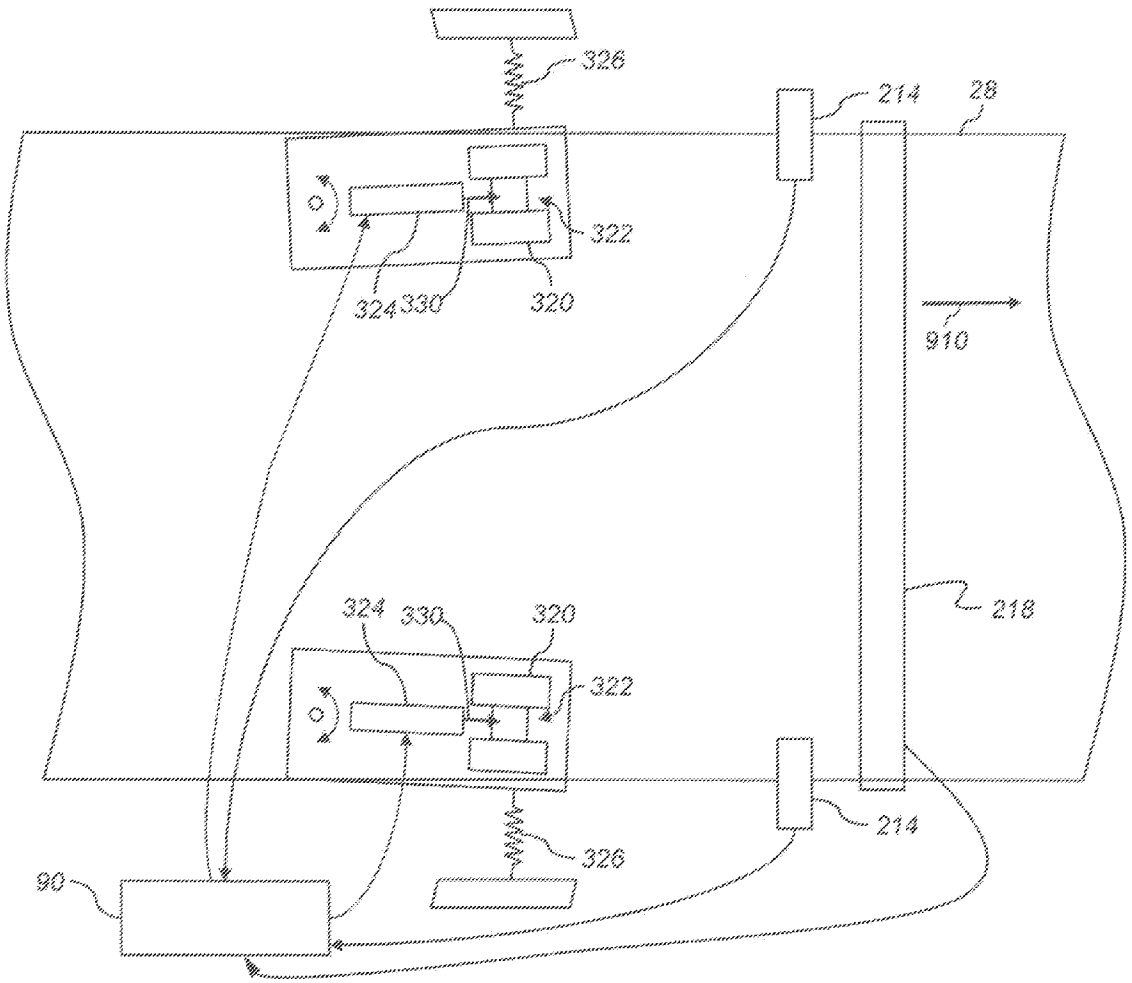
FIG. 13 shows of top view of a portion of a print station module having Bernoulli rollers to guide the print web.

FIG. 13 shows an alternate embodiment of tension gradient altering rollers. The tension gradient altering rollers comprise skewed narrow Bernoulli rollers 320 such as are taught in U.S. application Ser. Nos. 14/190,125; 14/190,127; and 14/190,137, all filed Feb. 26, 2014. The Bernoulli rollers 320 include a groove 322 through which air from an air source 324 is blown. The air flow 330 through the groove produces a low pressure region in the groove attracting the web of print media toward the grooved Bernoulli roller. The air flow can bring the print media into contact with the Bernoulli roller 320 sufficient to provide traction between the print media and the Bernoulli roller so that the print media rolls with little or no slippage over the Bernoulli roller. In this embodiment, one Bernoulli roller is located near each edge of the print media. The Bernoulli rollers 320 are skewed relative to the direction of media travel 910 by bias spring 326 such that a lateral force directed away from the centerline of the print media by the Bernoulli roller as the print media rollers over the Bernoulli roller. In one embodiment using Bernoulli rollers tension control adjustments comprise adjustments to the air source to vary the flow rate of the air directed through the groove of the Bernoulli roller and thereby varying the fraction between the print media and the skewed Bernoulli roller. When no air is directed through the groove of the roller, the print media is not held in contact with the skew roller so no lateral force is applied to the print media. When sufficient air flow is directed through the groove, the print media roll without slipping over the skewed roller, which then applies a lateral force to the print media. By separately controlling the air flow through the grooves of the Bernoulli rollers at the two edges of the print media, lateral forces can be applied to the print media to steer the print media in the direction of either edge of the print media. By providing air flow through the grooves of both Bernoulli rollers, outwardly directed lateral forces can be applied at both edges of the print media to spread or stretch the print media in the cross-track direction.

The printing system can be adapted to print a first copy of a print job on the web of print media 28. The print job can include a sequence of documents to be printed on one or both sides of the print media. An imaging system 218, is used to capture images of the pattern printed on the print media. From the captured images, a plurality of registration errors of the printed images can be determined, typically by the controller 90. Based on the plurality of registration errors, the processor 90 can determine tension control adjustments for the Bernoulli rollers. As subsequent copies of the print job are printed, the controller applies the tension control adjustments determined from the printing of the first copy of the print job by way of tension control commands to the air sources of the Bernoulli rollers to alter the traction of the print media with the Bernoulli rollers thereby alter the steering and/or the spreading of the print media and thereby reduce the registration errors. Preferably images are captured, with subsequent determination of registration errors and tension control adjustments, at a rate of one or more images and control adjustments being made per document in the sequence of documents of the first copy of the print job. During the printing of subsequent copies one or more tension control adjustments are applied to the Bernoulli rollers for each document in the sequence of documents that make up a print job. In this manner registration errors can be reduced for each document in copies of the print job printed after the first copy.

In another aspect of the invention, a system for using tension control adjustments to reduce registration errors while printing multiple copies of a print job can comprise a printing system, a sensor, and a processor. The printing system can include one or more print stations disposed opposite a first side of a web. The print stations define one or more print zones where a liquid is deposited onto the first side of the web. The printing system can also include one or more first rollers adapted to receive tension control commands, the tension control commands operating on the first rollers to control the amount of tension of print media in the printing system. The print stations can be arranged in one or more modules for printing on the web of print media. The tension zone can be all of the print stations used to print on one side of the print media, or each print station singly. The input and output equipment including the supply roll and take-up roll assemblies can also be defined as separate tension zones from the print station module tension zones. The printing system is used to print a first, a second, or a subsequent copy of the print job.

The sensor is used to determine a plurality of registration errors produced during the printing of the first, second, or subsequent copy of the print job. In one aspect of this invention, the sensor is a camera that can record images of registration marks printed by the printing stations on the web. Well known computer vision techniques can be used to compute the distance between the printed registration marks to determine the registration error using the processor. The processor can also be used to determine first tension control adjustments for each tension zone based on the plurality of registration errors and to use the first tension control adjustments to adjust the tension control commands to the one or more first rollers corresponding to each of the tension zones in the printing system. When printing a second copy of the print job, the tension control commands modify the tension in the tension zones, thereby reducing registration errors.

In another aspect of the invention, the processor is used to periodically or non-periodically update each stored tension control adjustment associated with the printing of subsequent copies of the print job. Second tension control adjustments for each registration error produced during the printing of the second or subsequent copy of the print job are determined. The stored tension control adjustments for each tension zone are updated using the respective second tension control adjustments associated with the printing of the second or subsequent copy of the print job. The tension control commands to the one or more first rollers corresponding to each of the tension zones are adjusted, based on the updated tension control adjustments, when printing a subsequent copy of the print job reduce registration errors.

Figure 14:
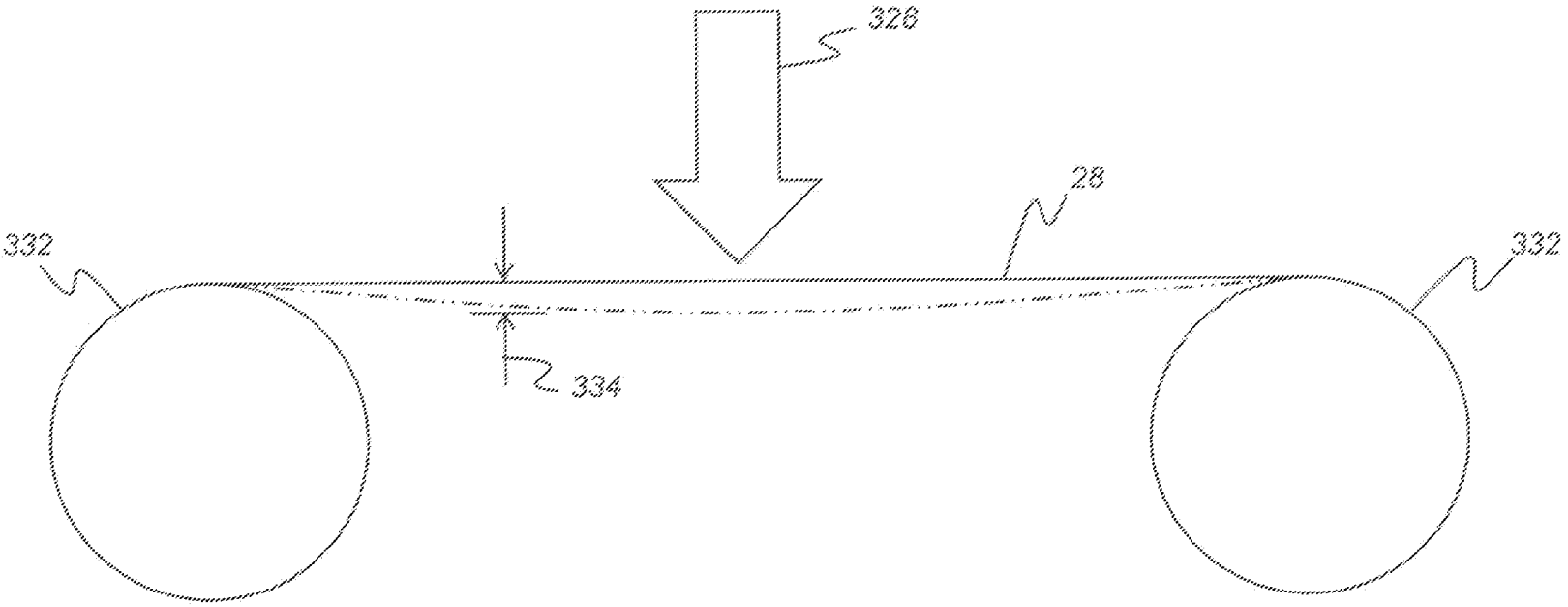
FIG. 14 shows a schematic side view of a web tension measurement system.

According to another aspect of the invention, the printing system can include second one or more rollers with load cells in one or more of the tension zones of the printing system. These rollers can be the same as one or more of the first rollers adapted to receive tension control commands, or a different set of rollers. The load cells are used to measure the tension in the printing system in one or more tension zones corresponding to the print station modules and, optionally, the supply roll and take-up roll assemblies. The second one or more rollers are high wrap rollers where the wrap angle subtended by the portion of the print media in contact with the roller is greater than 75 degrees and, preferably, greater than 90 degrees. Alternatively other tension measuring devices can be used. One alternate tension measuring system comprises applying a load or pressure 328 to the print media in a span between two fixed rollers 330, as shown in FIG. 14. A measurement of the web deflection 334 then provides a measure of the web tension in that span. Many transparent plastic films are photoelastic, such that the polarization angle of light passing through the material is changed depending on the stress or tension of the media. Polariscopic detection systems can be used to detect the change in polarization angle and thereby provide a measurement of the tension in the plastic film.

Figure 15:
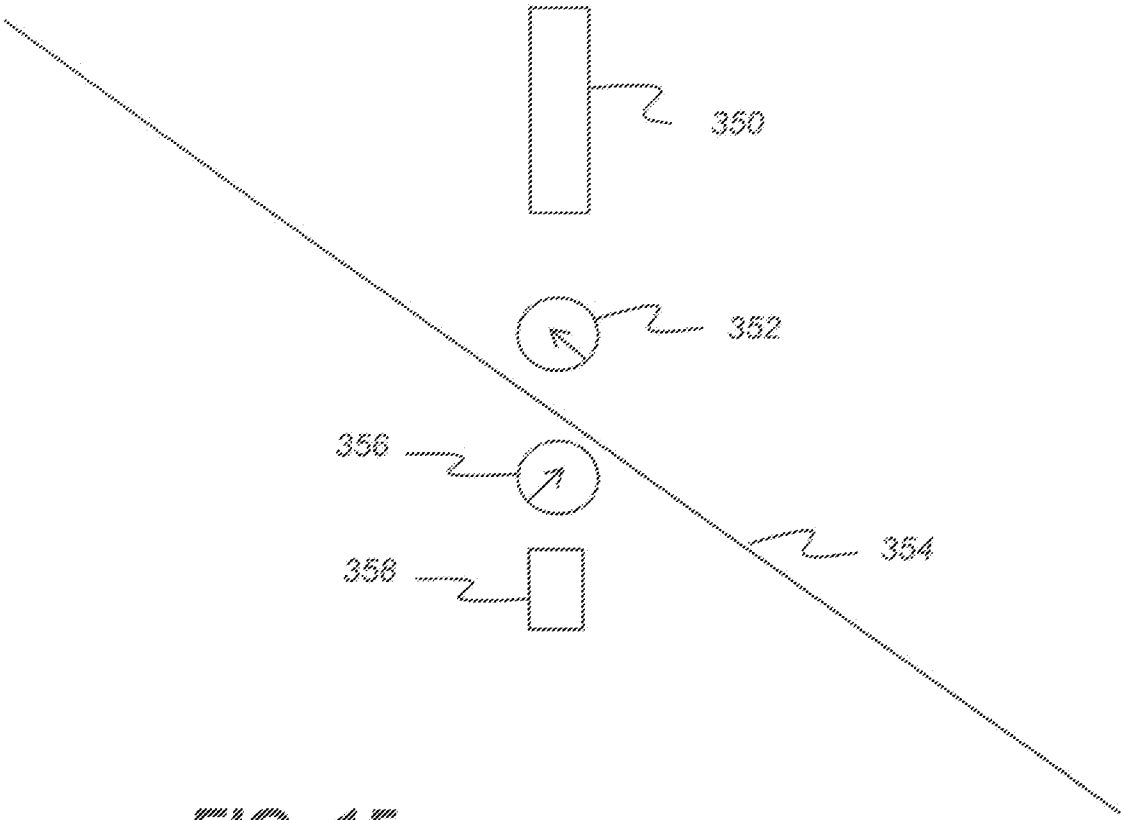
FIG. 15 shows a perspective view of polariscopic web tension measurement system.

A simple polariscopic system is shown in FIG. 15. A light source 350 directs light through a polarizing filter 352 onto a transparent photoelastic print media 354. On the opposite side of the print media is a second polarizing filter 356 and a light detector 358. The polarization axis of the second polarizing filter 356 is rotated by 90 degrees relative to the polarization axis of the first polarization filter 352, such that light passing through the first polarization filter is stopped by the second polarization filter unless the polarization of the light is rotated by the print media 28 that passes between the polarization filters. A measure of the amount of light passing through the second polarization filter by the light detector provides a measurement of how much the print media rotated the polarization axis of the light and thereby of the stress in the photoelastic print material. Tension measurements are made during the printing of each page in the print jobs, and the measurements are transmitted to the control logic processor 90.

According to another aspect of the invention, a system for reducing tension fluctuations while printing multiple copies of a print job includes a printing system, a sensor, and a processor. The printing system includes one or print stations disposed opposite a first side of a web, the print station defining one or more print zones where a liquid is deposited onto the first side of the web. One or more print zones can be isolated from other print zones, and from the supply and take-up roll assemblies, to create separate tension zones where the tension on the span of web within the tension zone can be controlled independently of the tension control in other tension zones. The printing system also includes one or more first rollers adapted to receive tension control commands, the tension control commands operating on the first rollers to control the amount of tension of print media in the printing system.

The sensor, such as load cells on the first rollers or on separate second rollers, measures tension changes produced in the tension zone defined by the print station during the printing of the print job. The processor is responsive to the sensor and determines first tension control adjustments for each tension zone based on the measured tension changes. The processor can also determine the first tension control adjustments to adjust the tension control commands to the one or more first rollers corresponding to each tension zone in the printing system when printing a second or subsequent copy of the print job, thereby reducing tension fluctuations.

It has been found that web transport systems as described above maintain effective control of the print media in the context of a digital print system where the selected portions of the print media are moistened in the printing process. This is true even when the print media is prone to expanding in length and width and to becoming less stiff when it is moistened, such as for cellulose based print media moistened by a water based ink. This enables the individual color planes of a multi-colored document to be printed with effective registration to each other.

Similarly, for the manufacture of touch screen panels the solvent based ink can soften the plastic support and lengthen it. A subsequent drying step can dry the solvent based ink, but also distort the plastic support as it is conveyed under tension past the individual printing and drying stations. Controlling the tension to reduce the deformation of the substrate or produce a consistent amount of deformation during the printing process can improve the registration of sequentially deposited image planes.

In the print jobs described above the print content of the different documents within a copy of the print job can vary widely. From one copy of the print job to the next copy, however the content of the individual documents should not change or not change significantly. While document 1 of the print job can have an ink laydown that is significantly different from documents 4 of the print job, for example, each copy of document 1 should be the same as the other copies of documents 1, with at most minor changes in content that don't alter the ink laydown profile significantly. As a result the tension fluctuations are consistent from one copy of the print job to the next.

The invention has been described in detail with particular reference to certain preferred embodiments thereof, but it will be understood that variations and modifications can be effected within the scope of the invention.

PARTS LIST

10. Printing system
12. Source roller
14. Dryer
16. Print station
18. Take-up roll
20. Print station module
22. Cross-track positioning mechanism
24. Tensioning mechanism
26. Constraint structure
28. Print media
30. Turnbar module
32. Drive roller
34, 36. Turnbar roller
40. Print station module
48. Support structure
50. Printing system
52. Slack loop
54. Print zone
70. Entrance module
72. Print station module
74. End feed module
76. Forward feed module
78. Print station module
80. Outfeed module
90. Control logic processor
110. Input Equipment
120. Output Equipment
200. Castered roller
202. Actuator
204. Edge detectors
206. Castered roller
208. Castered roller
210. Actuator
212. Actuator
214. Edge sensor
216. Edge sensor
218. Imaging system
220. First tension gradient zone
222. Second tension gradient zone.
300. Document
302. Registration pattern
304. Sequence of documents
306. Print job
320. Bernoulli roller
322. Groove
324. Air source
326. Bias spring
328. Load
330. Air flow
332. Roller
334. Deflection
348. Polariscopic system
350. Light source
352. Polarizing filter
354. Photoelastic material
356. Polarizing filter
358. Light detector
610. Web tension in Tension Zone #1
620. Web tension in Tension Zone #2
710. Step of providing printing station
720. Step of printing first copy of print job
730. Step of determining registration errors
740. Step of determining tension control adjustments
745. Step of storing tension control adjustments
750. Step of adjusting tension control commands
760. Step of printing second copy of print job
810. Step of accessing stored tension control adjustments
820. Step of printing second copy of print job
830. Step of determining registration errors
840. Step of determining tension control adjustments
850. Step of updating tension control adjustments
855. Step of storing tension control adjustments
860. Step of adjusting tension control commands
900. Page region
910. Arrow indicating direction of web transport
920. Registration mark
930. Registration mark
940. Registration mark
950. Registration mark
1010. Step of providing printing station
1020. Step of printing first copy of print job
1030. Step of measuring tension changes
1040. Step of determining tension control adjustments
1045. Step of storing tension control adjustments
1050. Step of adjusting tension control commands
1060. Step of printing second copy of print job
1110. Step of accessing stored tension control adjustments
1120. Step of printing second copy of print job
1130. Step of measuring tension changes
1140. Step of determining tension control adjustments
1150. Step of updating tension control adjustments
1155. Step of storing tension control adjustments
1160. Step of adjusting tension control commands
A. Edge guide
B, C, D, E, F, G, H, I, J, K, L, M, N, O, P. Rollers,
SW. S-wrap
TB. Turnbar module

The invention claimed is:

1. A method for using tension control adjustments on a web to reduce registration errors when printing a print job on the web, comprising:

providing a printing system with a first print station disposed opposite a first side of the web, wherein the first print station defines one or more print zones where a liquid is deposited onto the first side of the web, and a plurality of first rollers adapted to receive tension control commands;

defining a plurality of tension zones in the printing system, wherein tension on the web in one tension zone is controlled independently of the tension on the web in the other tension zones;

for each tension zone, associating at least one of the plurality of first rollers with the tension zone, the tension control commands operating on the first roller to control the amount of tension of the web in the tension zone;

using the printing system to print a first copy of the print job on the web;

determining a plurality of registration errors produced during the printing of the first copy of the print job;

using a processor to determine first tension control adjustments for each tension zone in the printing system based on the plurality of registration errors; and using the first tension control adjustments to adjust the tension control commands to the first rollers of each of the tension zones in the printing system to print a second copy of the print job, thereby reducing registration errors.

2. The method according to claim 1, further including storing the first tension control adjustments for each tension zone in processor-accessible memory for printing subsequent copies of the print job.

3. The method according to claim 1, further including:

determining at least one registration error produced during the printing of the second copy of the print job;

using the processor to determine second tension control adjustments for each corresponding tension zone based on each registration error produced during the printing of the second copy of the print job and to update each tension control adjustment using the respective second tension control adjustments associated with the printing of the second copy of the print job; and using the updated stored tension control adjustments to adjust the tension control commands to the first rollers of each of the tension zones in the printing system to print a subsequent copy of the print job, thereby reducing registration errors.

4. The method according to claim 3, further including storing the updated tension control adjustments for each tension zone in processor-accessible memory for printing subsequent copies of the print job.

5. The method according to claim 1, further including providing a second print station in the printing system, the second print station disposed opposite a second side of the web, the second print station defining one or more print zones where a liquid is deposited onto the second side of the web, and wherein at least one tension zone is associated with the first print station and at least one tension zone is associated with the second print station.

6. The method according to claim 1, wherein determining the first tension control adjustments further includes determining the first tension control adjustments based on an ink load printed on the web.

7. The method according to claim 1, further including providing a second roller in contact with the web, the second roller being associated with one of the tension zones in the printing system, and wherein using a processor to determine first tension control adjustments further includes:

measuring tension in the printing system using a load cell located on the second roller; and determining first tension control adjustments by computing a tension correction signal to increase the tension on the web to correct for a registration error corresponding to a lower tension measurement in the printing system or computing a tension correction signal to decrease the tension on the web to correct for a registration error corresponding to a higher tension measurement in the printing system.

8. The method according to claim 7, wherein the second roller is a fixed roller with high wrap angle.

9. The method according to claim 1, wherein the print job includes a plurality of pages associated with one or more documents in the print job and wherein determining the first tension control adjustments based on the plurality of registration errors includes:

determining an individual tension adjustment value for each page in the print job;

producing a profile of the individual tension adjustment values for all the pages in the print job; and using the produced profile to determine the first tension control adjustments.

10. The method according to claim 1, wherein the web is paper, wherein the printing system prints the print job using color separations, and wherein the registration errors are color-to-color registration errors.

11. The method according to claim 1, wherein the web is a substrate for a multi-layered electrical circuit, wherein the printing system prints the print job using conductive, insulating, or protective separations, and wherein the registration errors are alignment errors between the printed separations.

12. The method according to claim 11, further including providing jetting modules on the print station to jet electrically conductive inks, electrically insulating inks, or inks to form protective coatings for the electrical circuit.

13. The method according to claim 1, wherein the first rollers are drive rollers for the web.

14. The method according to claim 13, wherein the drive rollers include the infeed drive roller, the outfeed drive roller, or the turnbar roller.

15. The method according to claim 1, further including providing a web supply roll assembly disposed upstream of the first print station, wherein at least one tension zone is associated with the first print station and at least one tension zone is associated with the web supply roll assembly.

16. The method according to claim 1, further including providing a web take-up roll assembly disposed downstream of the first print station, wherein at least one tension zone is associated with the first print station and at least one tension zone is associated with the web take-up roll assembly.

17. The method according to claim 1, wherein the first tension control adjustments are represented using a discrete set of tension control parameters.

18. The method according to claim 1, wherein the first tension control adjustments are represented using a mathematical function.

19. The method according to claim 1, further including:

for each tension zone, measuring a tension gradient across a width of the web;

computing cross-track tension control adjustments to alter the cross-track positioning of the web; and using the first rollers to alter the cross-track position of the web in response to the cross-track tension control adjustments.

20. The method according to claim 1, wherein using a processor to determine first tension control adjustments further includes:

applying a load to the web in each tension zone;

measuring a deflection of the web in each tension zone in response to the applied load;

using a processor to compute a tension on the web in each tension zone based on the measured deflection of the web; and determining tension control adjustments based upon the computed tension on the web in each tension zone and the plurality of registration errors.

* * * * *